US005996250A

United States Patent [19]

Reed et al.

[11] Patent Number: 5,996,250

[45] Date of Patent: Dec. 7, 1999

[54] AIR-COOLED SHOE HAVING AN AIR EXHAUST PUMP

[76] Inventors: Rusty A. Reed, 2709 Ridgewood, Irving, Tex. 75014; Mark D. Murrell, 424 Halifax, Coppell, Tex. 75019

[21] Appl. No.: 09/199,587

[22] Filed: Nov. 25, 1998

Related U.S. Application Data

[60] Division of application No. 08/517,877, Aug. 3, 1995, Pat. No. 5,845,417, and a continuation-in-part of application No. 08/517,877, Aug. 3, 1995, Pat. No. 5,845,417, which is a continuation of application No. 08/325,678, Oct. 19, 1994, abandoned.

[51] Int. Cl.[6] ..... A43B 7/06

[52] U.S. Cl. ..... 36/3 R; 36/3 B

[58] Field of Search ..... 36/29, 3 R, 3 A, 36/3 B

[56] References Cited

U.S. PATENT DOCUMENTS

| | | | |
|---|---|---|---|
| 426,495 | 4/1890 | Falkner . | |
| 655,576 | 8/1900 | Pearson . | |
| 890,966 | 6/1908 | Critz, Jr. . | |
| 940,856 | 11/1909 | Critz, Jr. . | |
| 1,364,226 | 1/1921 | Wherry . | |
| 1,660,698 | 2/1928 | Williams, Sr. . | |
| 2,329,573 | 9/1943 | Ziegliss | 36/3 |
| 2,354,407 | 7/1944 | Shaks | 36/3 |
| 2,716,293 | 8/1955 | Rath | 36/3 |
| 2,751,692 | 6/1956 | Cortina | 36/3 |
| 3,331,146 | 7/1967 | Karras | 36/3 |
| 3,533,171 | 10/1970 | Motoki | 36/3 |
| 3,791,051 | 2/1974 | Kamimura | 36/3 |
| 3,973,336 | 8/1976 | Ahn | 36/3 |
| 4,420,893 | 12/1983 | Stephan | 36/3 |
| 4,776,110 | 10/1988 | Shiang | 36/3 |
| 4,995,173 | 2/1991 | Spier | 36/29 |
| 4,999,932 | 3/1991 | Grim | 36/88 |
| 5,068,981 | 12/1991 | Jung | 36/3 |
| 5,113,599 | 5/1992 | Cohen et al. | 36/88 |
| 5,179,792 | 1/1993 | Brantingham | 36/29 |
| 5,195,257 | 3/1993 | Holcomb et al. | 36/3 B |
| 5,224,277 | 7/1993 | Sang Do | 36/27 |
| 5,233,767 | 8/1993 | Kramer | 36/28 |
| 5,253,435 | 10/1993 | Auger et al. | 36/88 |
| 5,257,470 | 11/1993 | Auger et al. | 36/88 |
| 5,295,313 | 3/1994 | Lee | 36/3 |
| 5,341,581 | 8/1994 | Huang | 36/3 |
| 5,351,710 | 10/1994 | Phillips | 137/233 |
| 5,353,525 | 10/1994 | Grim | 36/88 |
| 5,375,345 | 12/1994 | Djuric | 36/3 |
| 5,408,760 | 4/1995 | Tse et al. | 36/3 R |
| 5,477,626 | 12/1995 | Kwon | 36/3 R |
| 5,505,010 | 4/1996 | Fukuoka | 36/3 |
| 5,515,622 | 5/1996 | Lee | 36/3 R |
| 5,638,612 | 6/1997 | Donzis | 36/29 |
| 5,675,914 | 10/1997 | Cintron | 36/3 R |
| 5,845,417 | 12/1998 | Reed et al. | 36/3 R |

FOREIGN PATENT DOCUMENTS

| | | |
|---|---|---|
| 2 193 080 | 2/1988 | United Kingdom . |
| 2 262 024 | 6/1993 | United Kingdom . |

*Primary Examiner*—B. Dayoan

*Attorney, Agent, or Firm*—Gregory M. Howison; Mark W. Handley

[57] ABSTRACT

An air cooled ventilated shoe (200) is provided for ventilating an area of the shoe (200) around a foot. The air-cooled shoe contains an outer sole (204). An intake tube (228) is disposed near the front of the outer sole (204). The intake tube (228) is connected to pump cell (210). An exhaust tube (234) is also connected to pump cell (210). An intake valve (242) is disposed along the intake tube (228) and an exhaust valve (244) is disposed along the exhaust tube (234). The intake valve (242) only allows air to flow through to the pump (210). The exhaust valve (244) only allows air to flow out of the pump cell (210). The pump cell (210) is filled with an open-celled foam (212) so that when no pressure is being applied to the pump cell (210), it draws air in through the intake tube (228). When pressure is applied to the pump cell (210), the open-celled foam (212) is compressed and the air is expelled through the exhaust tube (234). An alternative pump cell (352) may also be provided within a single flow port (358) which is connected to both an intake (368) within the shoe (200) and the exhaust from the shoe (200), with two one-way valves disposed in a singular valve pod (362) connected between the flow port (358) of the valve pod (352), and the intake (368) and the exhaust.

29 Claims, 14 Drawing Sheets

AIR-COOLED SHOE HAVING AN AIR EXHAUST PUMP

CROSS-REFERENCE TO RELATED APPLICATION

This application is a continuation-in-part of U.S. patent application Ser. No. 08/517,877, filed Aug. 3, 1995, now U.S. Pat. No. 5,845, 417, and entitled "AIR COOLED SHOE HAVING AN AIR EXHAUST PUMP," which is a continuation of U.S. patent application Ser. No. 08/325,678, filed Oct. 19, 1994, now abandoned and entitled "AIR COOLED SOLE,". Related in U.S. application Ser. No. 08/648,861, filed May 16, 1996, issued as U.S. Pat. No. 5,697,170 on Dec. 16, 1997.

TECHNICAL FIELD OF THE INVENTION

The present invention relates to a ventilated shoe and, more particularly, to a shoe having an air-pumping device to ventilate the shoe.

BACKGROUND OF THE INVENTION

Presently known ventilated shoes comprise elastomeric and resilient pads which are made of soft materials, such as sponge or rubber, and contain a plurality of holes in the sole and in the heel of the shoe in order to increase foot comfort. In these types of insoles, it is very difficult to remove moisture and the odor produced as a result of moisture which collects in the shoe due to foot sweating caused by poor shoe ventilation. Since most people use their shoes for long periods of time, it is essential to properly maintain and ventilate the shoes in order to avoid foot diseases, such as, for example, water-eczema.

According to a report of the American Podiatry Association, 75 percent of the males and females stand or walk for 4 hours a day. Such foot stress leads to foot problems, particularly in males, where athlete's foot fungi and the odor associated therewith are a common problem.

SUMMARY OF THE INVENTION

The present invention disclosed and claimed herein comprises an air-cooled shoe operable to ventilate the interior of the shoe and the area around a human foot. The shoe includes a sole having a toe portion, a ball portion and a heel portion. A shoe upper is formed above the sole and attached to the sole. A pump cell is disposed within the sole and is defined by a flexible material. The pump cell is filled with an open cell material which causes the pump cell to expand and fill with air. The pump cell has a single flow port which is in fluid communication with both the toe portion of the sole, inside the upper, and an air exhaust which is in fluid communication with the ambient air exterior of the shoe. Two one-way valves are disposed in a valve pod which allows air to enter the pump array in one direction and to exit the pump array in another direction. The single flow port of the pump cell defines an intake/exhaust port having a first and second end, with the first end connected to the interior of the pump cell and the second end connected to the valve pod. One of the one-way valves of the valve pod allows air to only enter the pump cell through the toe portion of the shoe, and the other one-way valve allows air to exit only through the air exhaust to the exterior of the shoe.

In a further aspect of the present invention, the air intake may be attached to a filtering device for filtering out large particles which are too large to be carried through the pump.

In another aspect of the present invention, the valve pod may be located at distal positions from the pump cell.

In still further yet another aspect of the present invention, a muffler may extend adjacent to the exhaust port of a pump cell to muffle the flow of exhaust fluids from within the air-cooled shoe to the atmosphere.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1A:
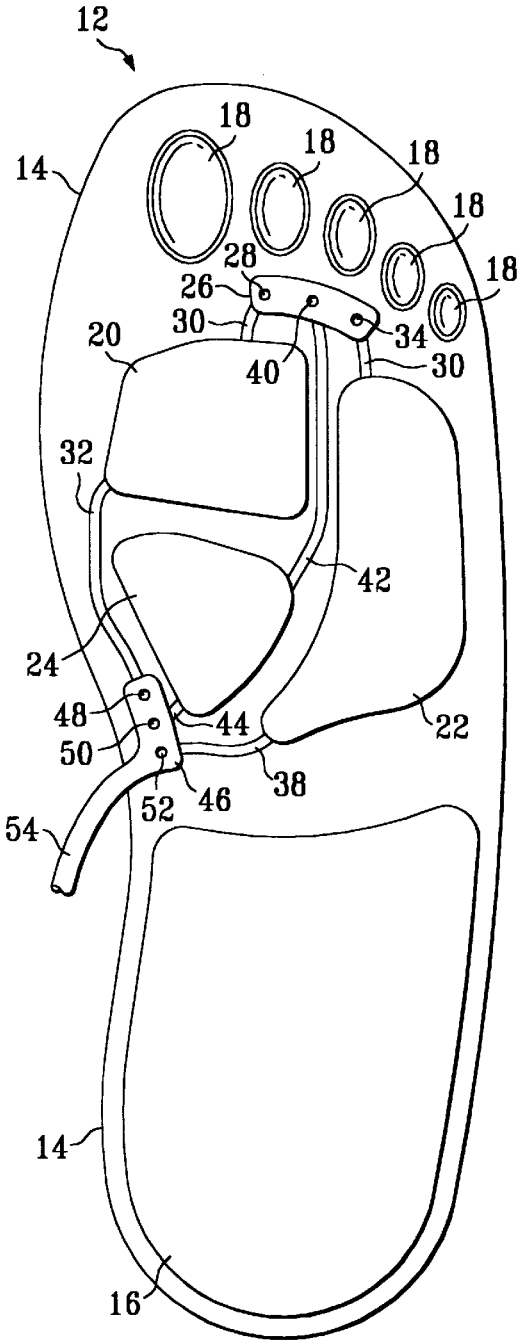
FIG. 1*a* illustrates a cutaway view of a first ventilation system for removing air and moisture from within a shoe.

Referring now to FIG. 1*a,* there is illustrated a cutaway view of a first ventilation system for removing fluids such as air and moisture from perspiration from within a shoe. It should be noted, that as used herein, the term shoe is used in a broad sense to include conventional foot ware such as tennis shoes, dress shoes, loafers and the like, but also boots, galoshes and the like. The moisture is typically from perspiration, and may be in both vapor and liquid phases. A sole 12 is provided as part of an overall shoe (not shown). An outer sole 14 is provided and is roughly in the shape of a human foot (not shown), which fits over the top of the sole 12. A heel pad 16 is disposed on the top of the outer sole 14 and covers the rear one-third area of the outer sole 14. Toe impressions 18 are provided at the front edge of the outer sole 14. The toe impressions 18 are slightly impressed areas of the outer sole 14 and are placed to coincide at the locations of the toes of a human foot (not shown) when placed over the sole 12. A front pump cell 20 is provided and is placed on top of the outer sole 14, such that it corresponds to the head of the metatarsus of the first shaft of the human foot and of the second shaft of the human foot, extending approximately halfway up the first and second shafts from the head towards the base. A right pump cell 22 is provided and placed above the outer sole 14. The right pump cell 22 corresponds to the area between the head and the base of the metatarsus of the third, fourth, and fifth shaft. A rear pump cell 24 is provided and placed on top of the outer sole 14. The location of the rear pump cell 24 corresponds to the location of the base of the metatarsus of the first and second shaft to midway between the base and the head of the metatarsus of the first and second shaft.

An intake manifold 26 is located between the toe impressions 18 in the front of the front pump cell 20 and the right pump cell 22. The intake manifold 26 is located such that it coincides the phalanges of the first through fifth shaft of the human foot. A front intake reed 28 is provided on the left side of the intake manifold 26 and is connected through a front intake tube 30 to the front pump cell 20. A rear intake reed 40 is provided in the center of the intake manifold 26 and is connected by a rear intake tube 42 to the rear pump cell 24. A right intake reed 34 is provided on the right side of the intake manifold 26 and is connected by the right intake tube 36 to the right pump cell 22. The intake reeds 28, 40 and 34 allow air and moisture to flow in only one direction into the pump cells 20, 22 and 24. An exhaust manifold 46 is provided and placed on the outer sole 14 of the sole 12. The exhaust manifold 46 is located under the arch of the human foot. Located on the upper portion of the exhaust manifold 46 is a front exhaust reed 48. The exhaust reed 48 is connected to the front pump cell 20 by a front exhaust tube 32. Located in the center of the exhaust manifold 46 is a rear exhaust reed 50. The rear exhaust reed 50 is connected to the rear pump cell 24 by a rear exhaust tube 44. Located on the lower portion of the exhaust manifold 46 is a right exhaust reed 52. The right exhaust reed 52 is connected to the right pump cell 22 by a right exhaust tube 38. The exhaust reeds 48, 50 and 52 allow air and moisture to pass through them in only one direction, that is, from the exhaust tubes 32, 44 and 38, respectively. The exhaust manifold 46 has one outlet into the outside air exterior of the shoe, which is connected to a tube 54 to pass air and moisture through the outer sole 14 of the sole 12.

Figure 1B:
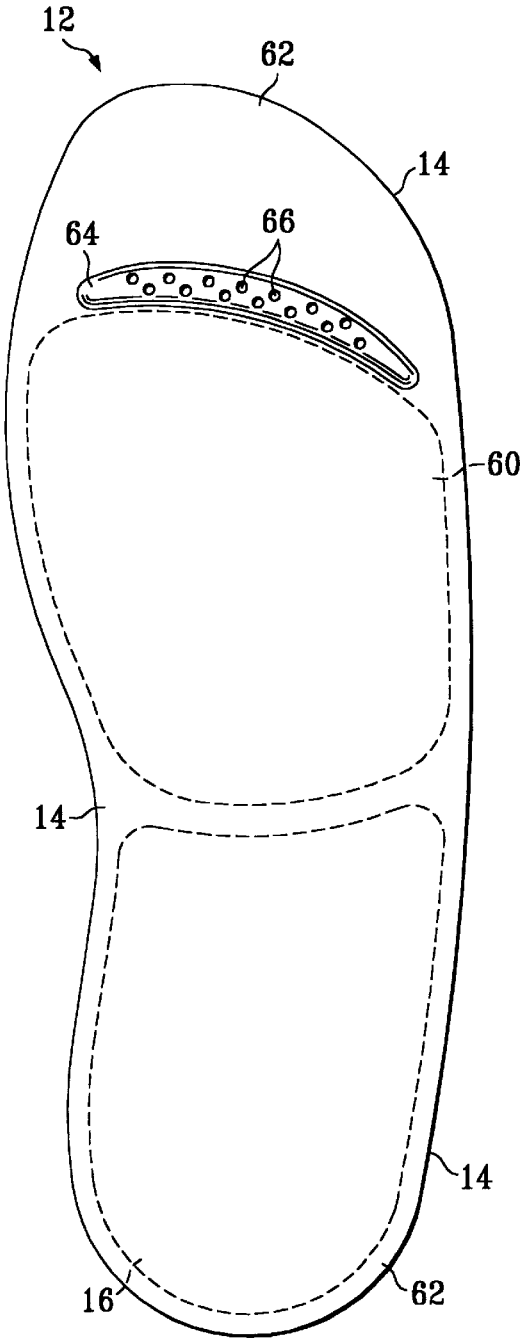
FIG. 1*b* illustrates a top view of the first ventilation system.

Referring now to FIG. 1*b,* there is illustrated a top view of the sole 12. The top layer of the sole 12 is a pad 62 running the full length of the sole 12 covering the outer sole 14. This pad 62 is the same shape as the outer sole 14. A semirigid layer 60 is located just beneath the pad 62 in an area covering the pump cells (not shown). A raised area 64 is located on the top of the pad 62 and coincides with an area just under the base of the phalanges of the first through the fifth shaft of the toes of the human foot. Disposed in the raised area 64 are intake holes 66. These holes 66 perforate the pad 62 to allow air to pass from the air around the foot, through the intake holes 66 and to the intake manifold 26 (not shown) located just beneath the intake holes 66. A semirigid layer 60 is used to support the foot while allowing the foot to press down against the pump cells (not shown). The heel pad 16 and the semirigid layer 60 are shown underneath the pad 62.

Figure 1C:
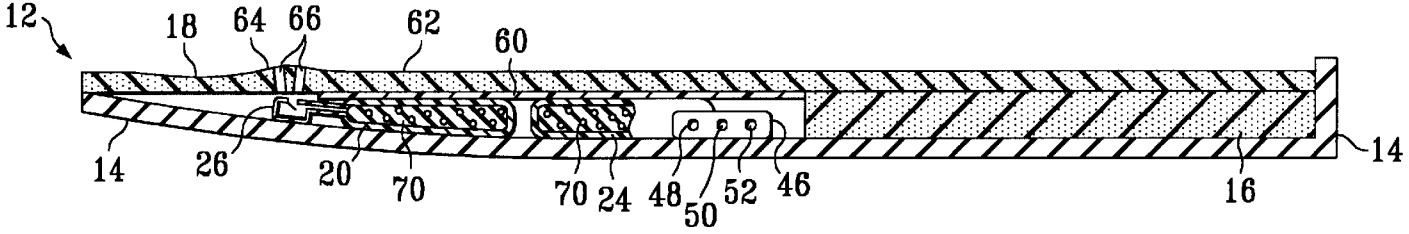
FIG. 1*c* illustrates a side cross-sectional view of the first ventilation system.

Referring now to FIG. 1*c*, there is illustrated a sectional view of the first ventilation system. The outer sole 14 extends from the rear of the shoe across the bottom of the rear of the sole 12, running the full length of the sole 12. The heel pad 16 extends from the rear of the outer sole 14 to one-third of the length of the outer sole 14. The exhaust manifold 46 includes the front exhaust reed 48, the rear exhaust reed 50 and the right exhaust reed 52. The rear pump cell 24, the front pump cell 20 and the intake manifold 26 are shown. Placed above the front air cell 20 and the rear air cell 24, the semirigid layer 60 runs from the front pump cell 20 to the rear of the exhaust manifold 46. Covering the full length of the sole 12, from the rear of the heel pad 16 to the front of the outer sole 14, is the pad 62. The toe impressions 18 are disposed in the pad 62. The raised area 64 is disposed just behind the toe impressions 18. The intake holes 66 perforate the pad 62 and are disposed in the area of the raised area 64. The intake holes 66 are also disposed just above intake manifold 26. The open-celled foam 70 is located inside the front pump cell 20 and the rear pump cell 24.

Figure 1D:
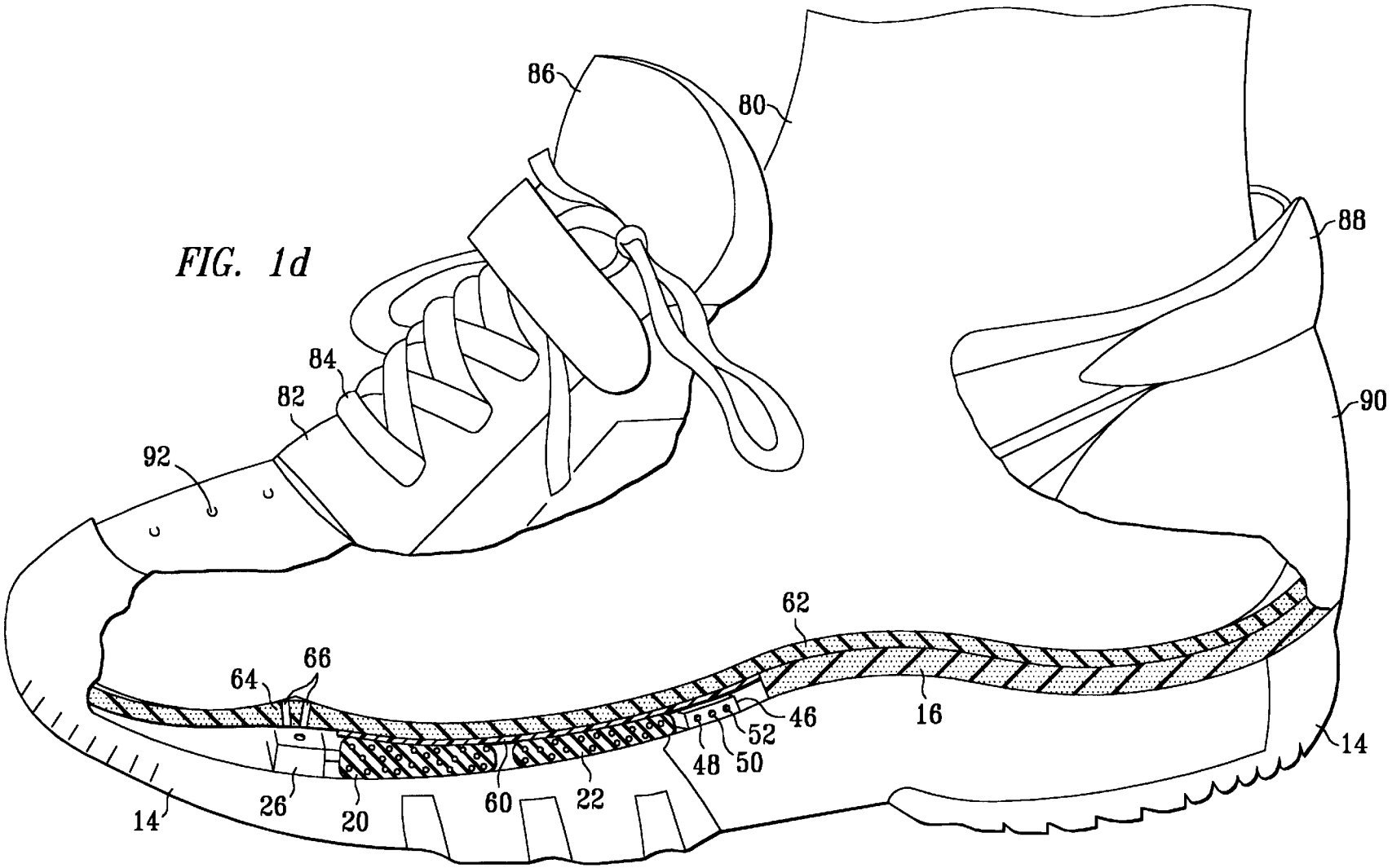
FIG. 1*d* illustrates a side cutaway view of the first ventilation system.

Referring now to FIG. 1*d,* there is illustrated a side cutaway view of a shoe which includes the first ventilation system. The outer sole 14 extends from the front of the human foot to the rear of the human foot 80. A typical tennis shoe upper 82 is attached to the outer sole 14. The tennis shoe upper contains laces 84, a tongue 86, a collar 88, and a body 90. The shoe has vents 92 in the toe area of the upper 82. The pad 62 extends from the heel of the foot 80 to the toes of the foot 80. The raised area 64 is positioned under the base phalanges of the foot 80. Intake holes 66 are disposed in the pad 62 at the raised area 64. The intake manifold 26 is disposed directly beneath the intake holes 66. The front pump cell 20 is disposed directly in front of the rear pump cell 24. The exhaust manifold 46 includes the front exhaust reed 48, the rear exhaust reed 50 and the right exhaust reed 52. The heel pad 16 is disposed between the foot 80 and the outer sole 14. The semirigid layer 60 is disposed between the pad 62 and the front pump cell 20 and the rear pump cell 24.

In operation, the human foot 80 fits over the sole 12. The human foot 80 is outlined by the outer sole 14. The heel of the human foot 80 fits over the heel pad 16, with the five toes of the human foot 80 each fitting into a corresponding one of the toe impressions 18. The front intake reed 28, the rear intake reed 40 and the right intake reed 34 allow air and moisture to pass only in one direction, from the interior of the shoe into the tubes 30, 42 and 36. The front exhaust 48, the rear exhaust reed 50, and the right exhaust reed 52 also only allow air and moisture to pass in only one direction, that being from the exhaust tubes 32, 38 and 44 through the outside exhaust tube 54. Therefore, when the pressure of the foot 80 is not pressing on the front pump cell 20, the right pump cell 22 and the rear pump cell 24, the open-celled foam 70 inside the pump cells 20, 22 and 24 causes the pump cells 20, 22 and 24 to expand, thereby drawing air into the intake manifold 26 and through the intake reeds 28, 40 and 34, through the intake tubes 30, 42 and 36, and into the pump cells 20, 22 and 24, respectively. This draws air and moisture from the interior of the shoe and around the foot into the front pump cell 20, the rear pump cell 24 and the right pump cell 22. Moisture from perspiration may be entrained in the cell as vapor and liquid moisture droplets.

When a person steps with his foot onto a surface, the foot then presses down on the pad 62, the front pump cell 20, the right pump cell 22 and the rear pump cell 24. This compresses the pump cells 20, 22 and 24 and compresses the open-celled foam 70 inside the pump cells 20, 22 and 24. This, in turn, causes the air and moisture from the front pump cell 20 to be expelled through the front exhaust tube 32, through the exhaust reed 48, and thereby through the outside exhaust tube 54 to the exterior of the shoe. This also causes air and moisture from the right pump cell 22 to be expelled through the right exhaust tube 38, through the right exhaust reed 52, and through the outside exhaust tube 54 to the exterior of the shoe. Finally, this causes air and moisture inside the rear pump cell 24 to be expelled through the tube 44, through the rear exhaust reed 50, and through the outside exhaust tube 54 into the outside ambient air exterior of the shoe. This happens with each step.

After a person lifts his foot off the ground to take another step, the air and moisture is drawn through the intake reeds 28, 40 and 34, through the intake tubes 30, 36 and 42, and into the pump cells 20, 22 and 24. Air and moisture is only drawn through the intake reeds 28, 40 and 34, and not through the exhaust reeds 48, 50 and 52, because air and moisture can only be expelled out of the exhaust reeds 48, 50 and 52 in the direction of the outside exhaust tube 54 from the pump cells 20, 22 and 24. Once the pump cells 20, 22 and 24 are filled with air and moisture when a person steps onto a surface, the foot presses down on the pump cells 20, 22 and 24, pressing them against the outer sole 14 of the sole 12, causing the pump cells 20, 22 and 24 to be compressed and the air and moisture to be expelled through the tubes 32, 44 and 38, through the exhaust reeds 48, 50 and 52, and through the outside exhaust tube 54 into the outside ambient air exterior of the shoe.

This first ventilation system, comprising multiple pump cells 20, 22 and 24, and multiple intake reeds 28, 34 and 40, provides consistent air and moisture transfer during changing foot positions and walking due to the multiple pump cells 20, 22 and 24 and and the semirigid layer 60 placed over the pump cells 20, 22 and 24. Since the pump cells 20, 22 and 24 each have individual intake reeds 28, 40 and 34, individual intake tubes 30, 42 and 36, individual exhaust tubes 32, 44 and 38, and individual exhaust reeds 48, 50 and 52, this allows the individual pump cells 20, 22 and 24 to operate independently from each other. This also causes increased service life due to the fact that the failure of the exhaust reeds 48, 50 and 52 is the most probable cause of system malfunction. Since each pump cell 20, 22 and 24 has its own exhaust reed 48, 50 and 52, the rate of reduction is fractional, since it is unlikely that all of the exhaust reeds 48, 50 and 52 will fail simultaneously.

Figure 2B:
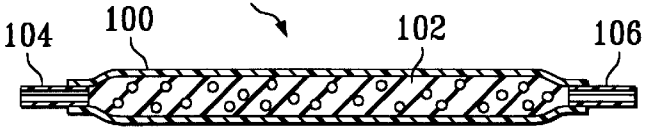
FIG. 2*b* illustrates a cross-sectional view of an assembled pump cell.
Figure 2C:
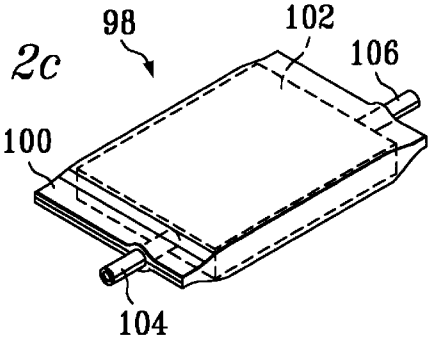
FIG. 2*c* illustrates a perspective view of the pump cell.
Figure 2A:
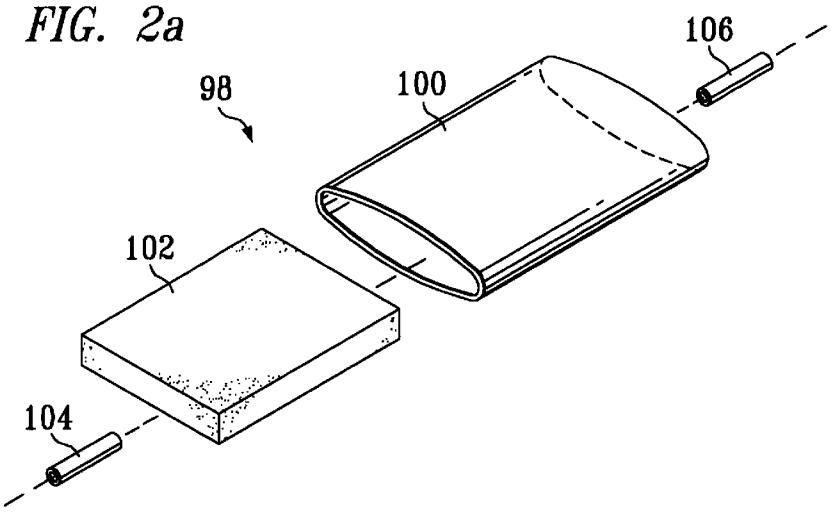
FIG. 2*a* illustrates an exploded diagram of the construction of the pump cells.

Referring now to FIG. 2*a,* there is illustrated an exploded diagram of the construction of a pump cell 98. The pump cell 98 consists of a plastic tube inlet 104, a plastic tube outlet 106, a main tubing 100, and an open-celled foam filler 102. Referring now to FIG. 2*b,* there is illustrated a longitudinal section view of an assembled pump cell 98. The plastic tube inlet 104 is inserted to the open-celled foam filler 102, which is inserted into the main tubing 100. The plastic tube outlet 106 is also inserted into the open-celled foam filler 102. Referring now to FIG. 2*c*, there is illustrated a perspective view of the pump cell 98. The open-celled foam filler 102 is disposed inside the main tubing 100, with the plastic tube inlet 104 inserted through the main tubing 100 and into the open-celled foam filler 102. The plastic tube outlet 106 is inserted into the open-celled foam filler 102 and through the main tubing 100.

In operation, the open-celled foam filler 102 is normally in an expanded position as shown in FIG. 2*b*, such that it holds the two sides of the main tubing 100 apart from each other. This in turn traps air and moisture in the open-celled foam filler 102. Air and moisture comes in through plastic tube inlet 104. The air and moisture may only flow inward through plastic tube inlet 104 and may only flow out through plastic tube outlet 106. When the main tubing 100 is compressed by a human foot (not shown), the open-celled foam filler 102 is compressed together and the two sides of the main tubing 100 move towards each other. This in turn causes the air and moisture inside the open-celled foam filler 102 to be expelled through the plastic tube outlet 106.

Figure 3A:
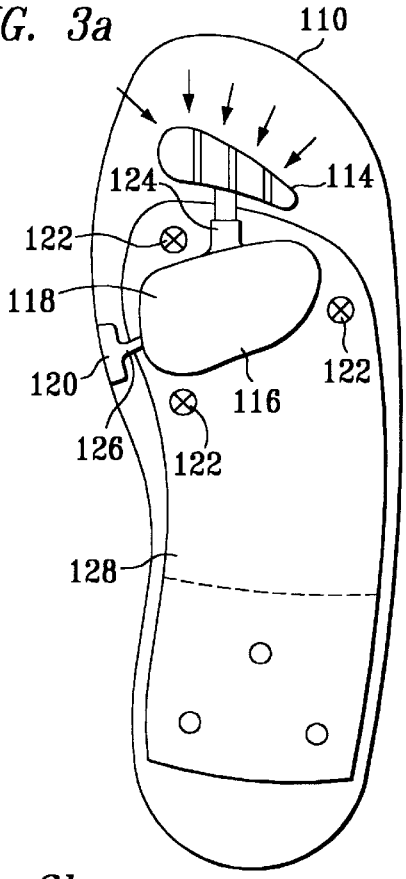
FIG. 3*a* illustrates a second ventilation system.
Figure 3B:
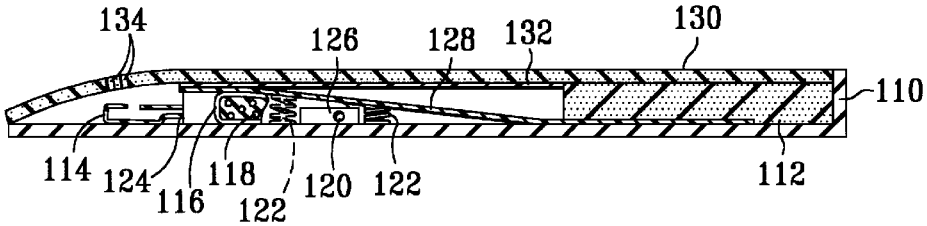
FIG. 3*b* illustrates a cross-sectional view of the second ventilation system.

Referring now to FIGS. 3*a* and 3*b*, there is illustrated a second embodiment of a shoe ventilation system. An outer sole 110 is approximately the shape of an outline of a human foot. A heel pad 112 covers the rear one-third of the outer sole 110. An intake grille 114 is provided. A pump bladder 116 is filled with an open-celled foam 118. The pump bladder 116 is connected to the intake grille 114 through an inlet reed valve 124. An exhaust port 120 is connected to the pump bladder 116 through an outlet reed valve 126. A pump lever 128 extends from below the heel pad 112 up to the intake grille 114. Pump return springs 122 are positioned between the outer sole 110 and the pump lever 128. The pump lever 128 is positioned such that it is directly above the pump bladder 116. A semirigid layer 132 is then positioned above the pump lever 128, and a pad 130 is positioned above the heel pad 112. The semirigid layer 132 runs the full length of the outer sole 110 from the front of the outer sole 110 to the rear of the outer sole 110. Intake holes 134 are disposed in the pad 130 running through the fall height of the pad 130.

In operation, when a human foot is not pressing upon the pad 130, this allows the open-celled foam 118 inside the pump bladder 116 to expand, drawing air and moisture from around the toes of a human foot, through the intake holes 134, through the intake grille 114, through the inlet reed valve 124 and into the pump bladder 116. When the human foot is pressed down on the pad 130, it pushes the semirigid layer 132 down upon the pump lever 128, which compresses the open-celled foam 118 in the pump bladder 116 and expels the air and moisture in the pump bladder 116 through the outlet reed valve 126, and then through the exhaust port 120. When pressure is released from the pump lever 128, the pump lever is raised by the pump return springs 122, such that the open-celled foam 118 in the pump bladder 116 may expand to draw in air and moisture from the shoe interior around the foot.

Figure 4A:
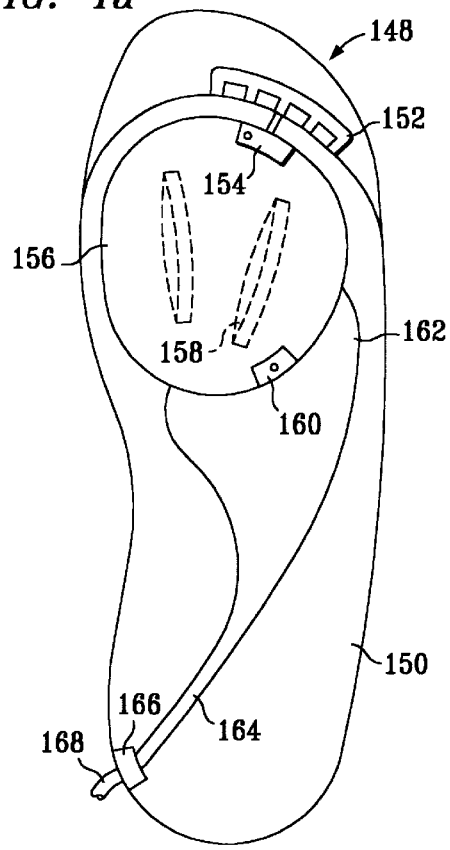
FIG. 4*a* illustrates a cutaway drawing of a shoe insert utilizing ventilation system.

Referring now to FIG. 4*a*, there is illustrated a cutaway drawing of a shoe insert 148 utilizing a third ventilation system. The shoe insert 148 consists of a base 150. The insert 148 also consists of an intake manifold 152. The intake manifold 152 is connected to a main pump cell 156 through an intake reed valve 154 which allows air and moisture to travel only from the direction of the intake manifold 152 to the main pump cell 156. The main pump cell 156 has semirigid walls and is expanded by leaf springs 158 disposed on the interior of the main pump cell 156. The main pump cell 156 is connected to a secondary pump cell 162 through a first exhaust reed valve 160, which allows air and moisture to flow only in the direction from the main pump cell 156 to the secondary pump cell 162. An exhaust tube 164 is connected to the secondary pump cell 162. The exhaust tube 164 has disposed near its end a second exhaust reed valve 166 which allows air and moisture to flow only from the secondary exhaust bladder 162 and not into the secondary exhaust bladder 162. A tube 168 is connected to the outward side of the second exhaust reed valve 166.

Figure 4B:
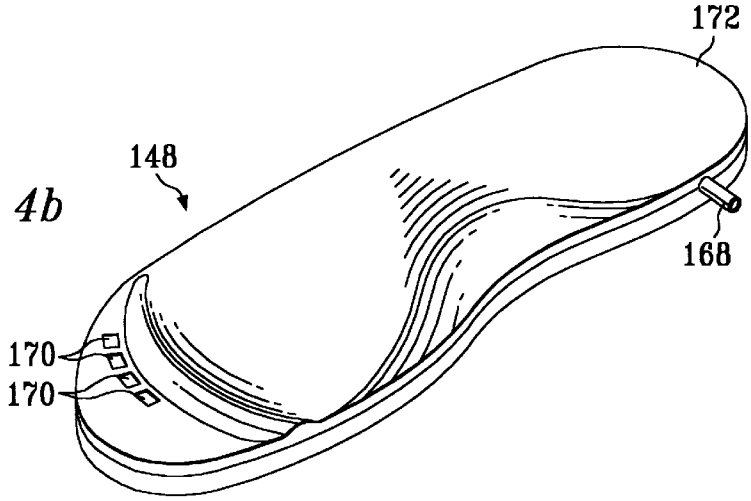
FIG. 4*b* illustrates a perspective view of the shoe insert system.

Referring now to FIG. 4*b*, there is illustrated a perspective view of the complete insert 148. A pad 172 is disposed over the full length of the base 150. Disposed in the pad 172 near the front of the pad 172 are intake holes 170. The intake holes 170 allow air and moisture from around the toes of the foot to travel through the pad 172 to the intake manifold 152.

In operation, the insert 148 can be disposed inside a normal athletic shoe between the foot of the wearer and the sole of the shoe. Once the insert 148 is inserted into a normal athletic shoe between the foot of the wearer (not shown) and the sole of the athletic shoe, the secondary pump cell 162, and the main pump cell 156 are filled with air and moisture. When a person first steps down with their heel, their foot presses the air and moisture out of the secondary pump cell 162, through the exhaust tube 164, out the second exhaust reed valve 166, and out the outlet tube 168. When a person rolls onto the ball of their foot, air and moisture are expelled from the main pump cell 156, through the exhaust reed 160, and into the secondary exhaust cell 162. When a person then completes his step and lifts his foot off of the ground, the leaf springs 158 in the main pump cell 156 expand the main pump cell 156, drawing air and moisture through the intake holes 170 from around the toes of the human foot (not shown), into the intake manifold 152, through the intake reed 154 valve, and into the main pump cell 156. Then the cycle starts over again with the person expelling the air and moisture from the secondary pump cell 162, and then expelling the air and moisture from the cell 156 into the secondary pump cell 162 as stated above.

Figure 5:
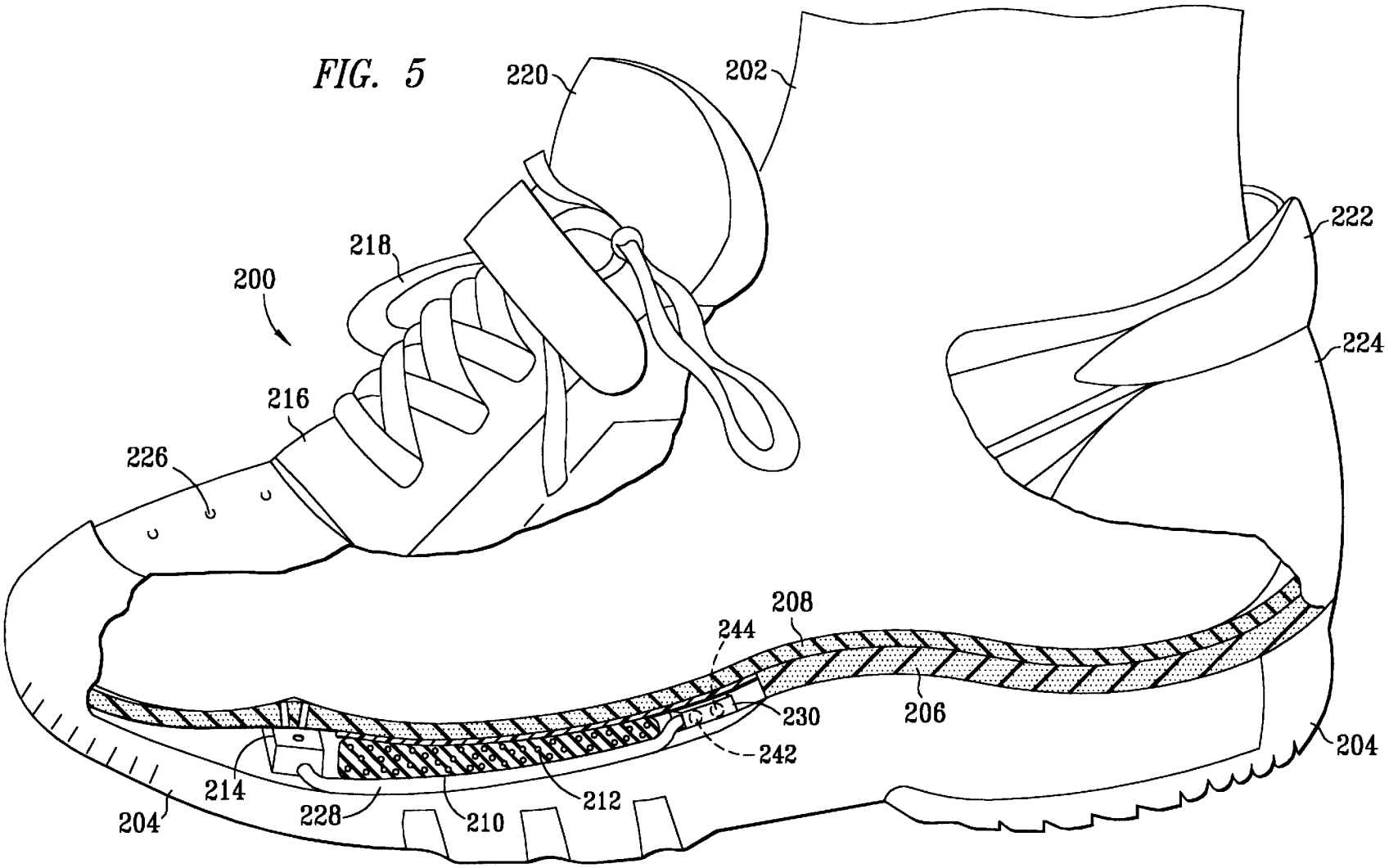
FIG. 5 illustrates a side cutaway view of the ventilated shoe.

Referring now to FIG. 5, there is illustrated a side cutaway view of a fourth ventilation system. A ventilated shoe 200 is shown. A human foot 202 is disposed inside the ventilated shoe 200. An outer sole 204 is provided. A typical tennis shoe upper 216 is connected to the outer sole 204. The tennis shoe upper contains laces 218, a tongue 220, a collar 222 and a body 224. The upper 216 of the ventilated shoe 200 has vents 226 disposed in the toe area. A pump cell 210 is disposed between the human foot 202 and the outer sole 204. Disposed inside the pump cell 210 is open-cell foam 212. The pump cell 210 is disposed in an inner sole 208. Also disposed in the inner sole 208, near the toe portion of the human foot 202, is a filter 214. Connected to the filter 214 is an intake tube 228. The intake tube 228 runs from the filter 214 along the pump cell 210 to the midsection of the human foot 202. A valve pod 230 is disposed near the midsection of the inner sole 208. The valve pod 230 contains two one-way valves, one valve being an intake valve 242 and the other being an exhaust valve 244, which are shown in FIG., 6*b*. The intake tube 228 is connected to the inlet of the intake valve 242. The outlet of the intake valve 242 is connected to the pump cell 210. The inlet of the exhaust valve 244 is connected to the pump cell 210 and the outlet thereof is connected through an opening 232 to the outside ambient air. A heel pad 206 is disposed in the inner sole 208 between the valve pod 230 and the rear of the shoe 200.

Figure 6A:
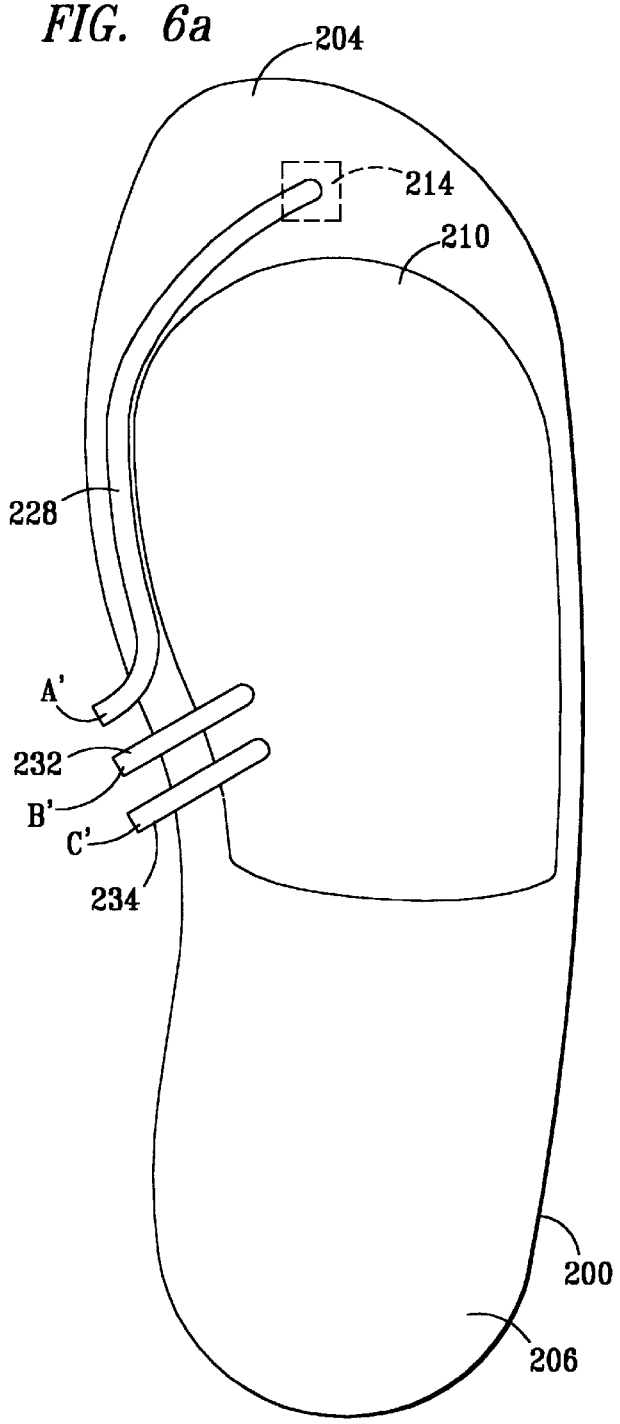
FIG. 6*a* illustrates a top view of the ventilated shoe with the upper and the inner sole removed.

Referring now to FIG. 6*a*, there is illustrated a top view of the ventilated shoe 200 with the upper 216 and the inner sole 208 removed. The outer sole 204 has the shape of an outline of the human foot 202 (shown in FIG. 5). The heel pad 206 is disposed on top of the outer sole 204 and covers the rear one-third area of the outer sole 204. The pump cell 210 is disposed on the outer sole 204. Intake tube 228 extends from the toe portion of the outer sole 204 to exit the outer sole 204 at the midsection. The pump intake tube 231 has one end connected inside the pump cell 210 and the other end extending outward from the outer sole 204 near the area where the intake tube 228 extends from the outer sole 204. An exhaust tube 234 is disposed such that it extends from inside the pump cell 210 to the outside of outer sole 204 in the approximate area of the pump intake tube 232. Proximate to the area where the intake tube 228, the pump intake tube 232 and the exhaust tube 234 exit, the outer sole 204 may be recessed such that the area is indented into the outer sole 204.

Figure 6B:
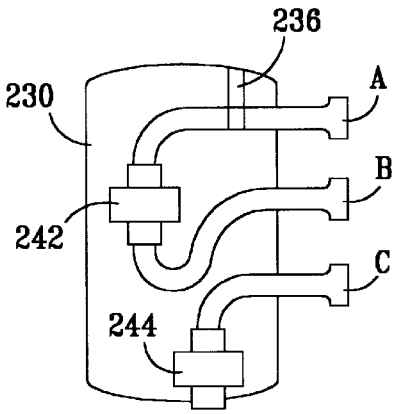
FIG. 6*b* illustrates a cutaway view of the valve pod.

Referring now to FIG. 6*b*, there is illustrated a cutaway view of the valve pod 230. The valve pod 230 contains the intake valve 242 and the exhaust valve 244. The intake valve 242 and the exhaust valve 244 allow air and moisture to pass in only one direction from the inlet to the outlet. The inlet A of the intake valve 242 is connected to the outlet A' of the intake tube 228. The outlet B of the intake valve 242 is connected to the open end B' of the pump intake tube 231. The inlet C of the exhaust valve 244 is connected to the second end C' of the exhaust tube 234 and the outlet of the exhaust valve 244 is connected through the opening 232 (shown in FIG. 5) to the outside ambient air. The valve pod 230 is thus located on the outside of the outer sole 204 of the ventilated shoe 200. This allows for easy cleaning and replacement of the valve pod 230. The pump cell 210 may be bonded together by adhesives exclusively, or may be bonded by heat means. The outlet side of the exhaust valve 244 may be fitted with a charcoal filter or condenser, as needed. The pump intake tube 231 may be located at the left rear of the pump cell 210, as shown in FIG. 6*a*, or it may be located at the extreme rear of pump cell 210, or at the front of pump cell 210. It does not matter where the pump intake tube 231 or the exhaust tube 234 connects to pump cell 210. An optional cut-off valve 236 may also be provided for selectively sealing against flow through the valve pod 230.

Figure 7:
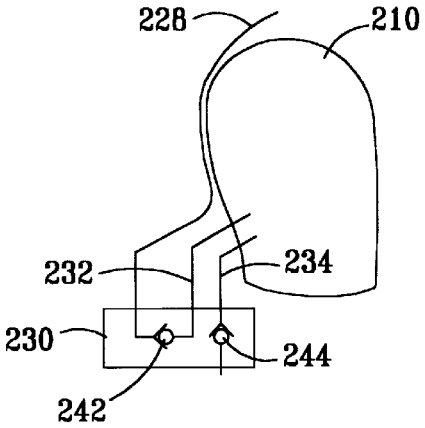
FIG. 7 illustrates a schematic diagram of the ventilated shoe and valve pod.

Referring now to FIG. 7, there is illustrated a schematic diagram of the apparatus shown in FIGS. 6*a* and 6*b*. The pump cell 210 has the pump intake tube 231 connected thereto and the exhaust tube 234 also connected thereto. The intake tube 228 is connected to the inlet of intake valve 242. The outlet of intake valve 242 is connected to the pump intake tube 232 whose opposite side is connected to the pump cell 210. The opposite side of exhaust tube 234 is connected to the inlet of exhaust valve 244. The outlet of exhaust valve 244 is connected to the outside ambient air through the opening 232.

In operation, the human foot 202 fits over the outer sole 204 and into the upper 216 of the ventilated shoe 200. The heel of the human foot 202 fits over the heel pad 206. The toes of the human foot 202 fit into the front of the ventilated shoe 200 with the arch between the toes and the foot fitting just over the filter 214. Air and moisture are allowed to pass through the filter 214, through the intake tube 228, through the intake valve 242, and through the pump intake tube 232 and into the pump cell 210. This is allowed to happen when the human foot 202 is not exerting pressure on the pump cell 210, so that the open-cell foam 212 in the pump cell 210 expands the pump cell 210. This draws air and moisture from the interior of the shoe 200 into the pump cell 210. The intake valve 242 allows the air and moisture to only pass from the intake tube 228 into the pump intake tube 231 and in that particular direction. The air and moisture are not allowed to pass from the pump cell 210, back through the pump intake tube 231 into the intake tube 228. Air is then drawn into the shoe 200 through the vents 226 and around the collar 222 to replace the air that is drawn through the filter 214 into the pump cell 210.

When pressure is exerted from the human foot 202 onto the outer sole 204, the pump cell 210 is compressed by the pressure. This in turn compresses the open-cell foam 212 which is inside the pump cell 210. This causes the air and moisture from the pump cell 210 to be expelled through the exhaust tube 234, and pass through the one-way exhaust valve 244 and the opening 232 into the outside ambient air exterior of the shoe 200. The exhaust valve 244 does not allow air or liquid from the outside to pass through opening 232, through the exhaust valve 231, into the exhaust tube 234 and into the pump cell 210. When the human foot 202 is then lifted off the ground, the air and moisture are once again drawn through the filter 214, through the intake tube 228, through the intake valve 242, and through the pump intake tube 244 into the pump cell 210. A cut-off valve (not shown) may be added between the filter 214 and the intake valve 242 along the intake tube 228. If the cut-off valve is activated, the air and moisture will no longer be drawn from the area around the human foot 202.

Figure 8A:
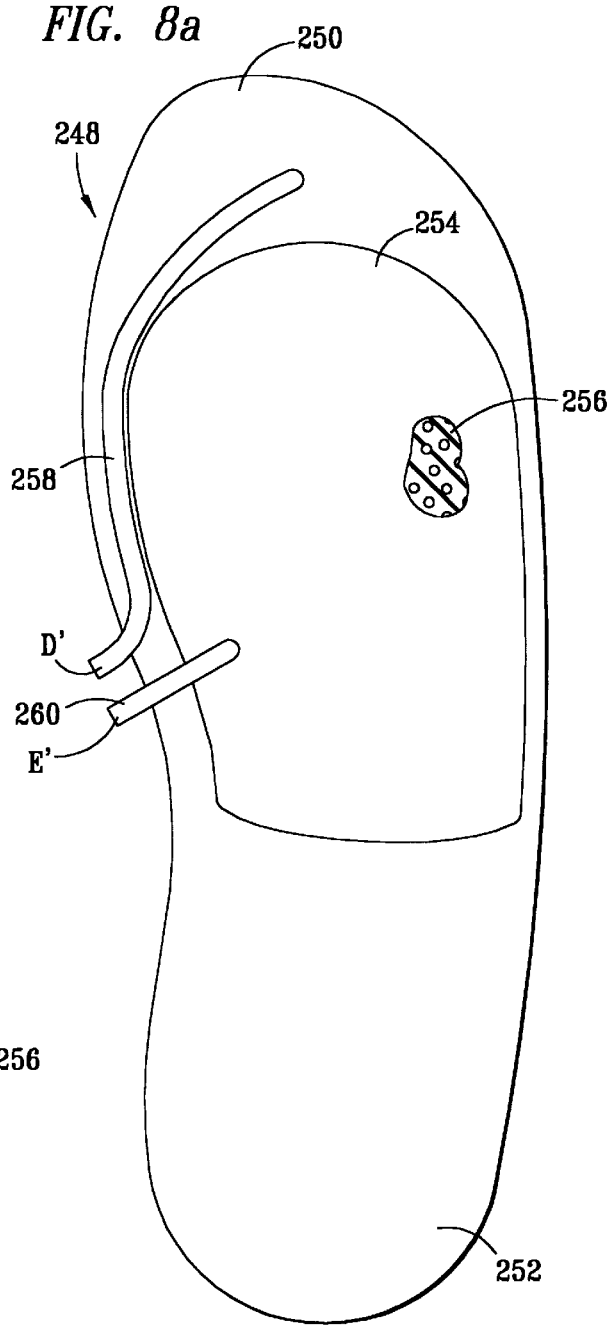
FIG. 8*a* illustrates a top cutaway view of an additional embodiment of a ventilated shoe with the shoe upper and inner sole removed.

Referring now to FIG. 8*a*, there is illustrated a top cutaway view of a fifth embodiment of a ventilated shoe 248 with the shoe upper and inner sole removed. An outer sole 250 has a shape of an outline of a human foot. A heel pad 252 is disposed on top of the outer sole 250 and covers a rear one-third area of the outer sole 250. A pump cell 254 is shown disposed on the outer sole 250 covering an area from approximately the toe area of the outer sole 250, along two-thirds of the outer sole 250, and also covering nearly the full width of the outer sole 250. An intake tube 258 is disposed to extend from the toe portion of the outer sole 250 to the midsection of outer sole 250 and has an outlet D'. A monotube 260 provides a singular flowport which extends from the interior of the pump cell 254 and through the outer sole 250 to exit the outer sole at port E', adjacent to the intake tube 258. The monotube 260 may be located at the rear, sides, or front of the pump cell 254. Also, the pump cell 254 may be confined to just the toe section of the outer sole 250, or may run throughout the entire surface area of the outer sole 250. Both the intake tube 258 and the monotube 260 may be merely passages between the pump cell 254 and either the interior of the shoe with respect to intake tube 258 and the exterior of the shoe with respect to the monotube 260. The intake tube 258 and the monotube 260 exit the outer sole 250 and are recessed such that the area is indented in the side of the outer sole 250. An open-cell foam 256 or other expandable material may be used to fill the pump cell 254, such that when pressure is released from on top of the pump cell 254, the open-cell foam 256 will expand the pump cell 254.

Figure 8B:
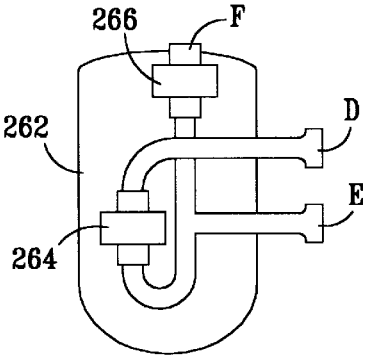
FIG. 8*b* illustrates a cutaway view of a valve pod.

Referring now to FIG. 8*b*, there is illustrated a cutaway view of a valve pod 262. An intake valve 264 is disposed in the valve pod 262. Intake valve 264 has an inlet D and an outlet E. The inlet D of the valve 264 is connected to the outlet D' of intake tube 258. The outlet E of the intake valve 264 is connected to the monotube 260. An exhaust valve 266 is also provided and disposed in the valve pod 262. The exhaust valve 266 has an inlet E and an outlet F. The outlet F of the exhaust valve 266 is open to the outside air exterior of the shoe through the side of valve pod 262. The inlet E of the exhaust valve 266 is connected to the monotube 260, and is also the same port as the outlet E of the intake valve 264. The valve pod 262 fits in the recessed area of the outer sole 250 and connects to the intake tube 258 and the monotube 260. The intake valve 264 allows air and moisture to pass in a one-way direction from the intake tube 258, through the monotube 260 and into the pump cell 254. The exhaust valve 266 allows air and moisture to pass in a one-way direction from the pump 254, through the monotube 260, and through the exhaust valve 266.

Figure 9:
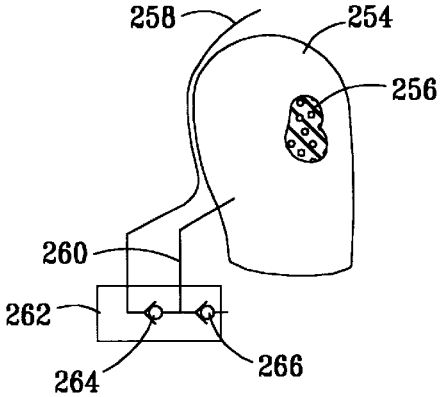
FIG. 9 illustrates a schematic diagram of the additional embodiment of the ventilated shoe and valve pod.

Referring now to FIG. 9, there is illustrated a schematic diagram of the apparatus shown in FIGS. 8*a* and 8*b*. The pump cell 254 has a monotube 260 connected thereto. The intake tube 258 is connected to the inlet D of the intake valve 264 of the valve pod 262. The outlet E of intake valve 264 is connected to the monotube 260. The inlet E of the exhaust valve 266 of the valve pod 262 is also connected to the monotube 260 with the outlet F of the exhaust valve 266 connected to the outside ambient air. The opposite end of monotube 260 is connected to pump cell 254.

In operation, the human foot fits over the outer sole 250 and into the upper of the ventilated shoe 248. The heel of the human foot fits over the heel pad 252. The toes of the human foot fit into the front of the ventilated shoe 248, over the front of the outer sole 250 with the arch between the toes and the foot fitting just over a filter (not shown), which is positioned just over the inlet of inlet tube 258. When pressure is released from the pump cell 254 and the open-cell foam 256 inside the pump cell 254 causes the pump cell 254 to expand, air and moisture are drawn through the filter and into the inlet of intake tube 258. The air and moisture then passes through intake valve 264 and through the monotube 260 into the pump cell 254. Once the open-cell foam 256 is expanded and the pump cell 254 contains air and moisture, pressure on the pump cell 254 from the human foot compresses the open-cell foam 256, which is inside the pump cell 254. This, in turn, causes air and moisture inside the pump cell 254 to pass through the monotube 260 and through the exhaust valve 266 to the outside ambient air. Air and water are not allowed to pass from the outside ambient air through the exhaust valve 266 and into the pump cell, nor is air or liquid allowed to pass from the pump cell 254, through the intake valve 264, into the intake tube 258 and into the interior of the shoe 248. An optional cutoff valve 265 may be added between the inlet of the intake tube 258 and the intake valve 264 along the intake tube 258. If the cutoff valve is activated, air will no longer be drawn from the area around the human foot.

The exhaust pressure from the exhaust valve 266 may be used to operate connected energy devices, such as a pressured drink bottle or inflatable suspension support devices. Also, the rate at which air or water may be exhausted from the exhaust valve 266 may be regulated by a regulator, such that a pressure cushion is kept in the pump cell 254 and air is only exhausted when the pressure rises above a given air pressure. The regulator controls the regulated release of the exhaust by restriction of the exhaust opening to provide a collapsing cushion with a rate of collapse determined by the size of the exhaust passage. The regulator may be provided with fixed flow orifice size, or with a flow orifice which is selectably size adjustable.

Figure 10A:
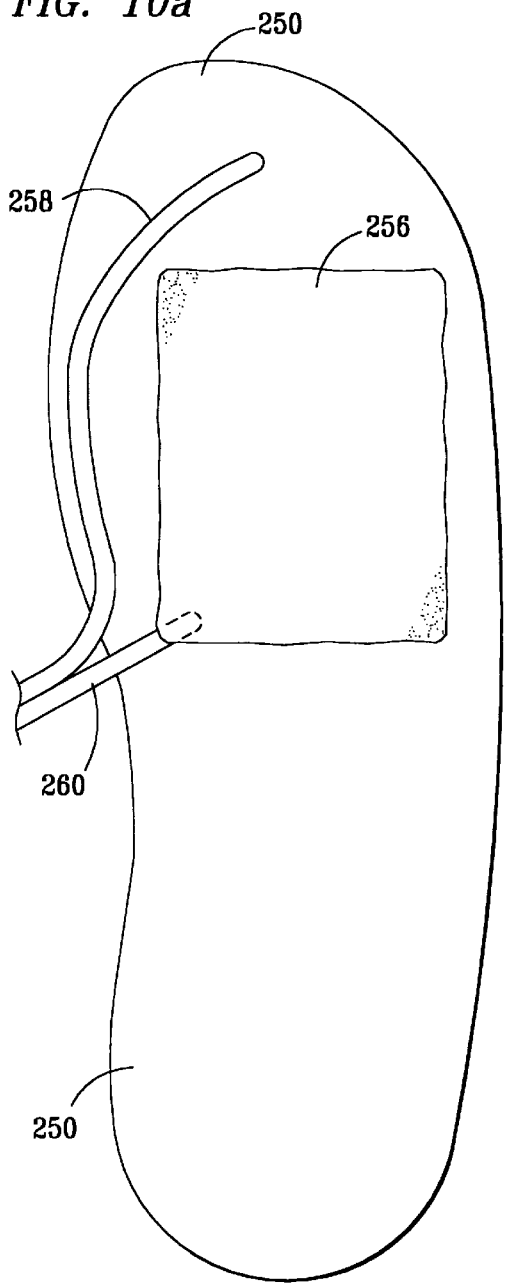
FIG. 10*a* illustrates a top view of a yet further embodiment of a ventilated shoe with the upper removed.

Referring now to FIG. 10*a,* there is illustrated a top view of a ventilated shoe with the upper removed. In a first step of a production technique to manufacture a sole 250 of the ventilated shoe described above with respect to FIGS. 8*a*, 8*b*, and 9, the open-cell foam 256, the intake tube 258, and the monotube 260 are placed in an injection mold for the sole 250. These elements are placed over the sole 250 and in the area to be injection molded to form the insole of the shoe. At this point, closed cell, airtight material (not shown) is forced into the confines of the mold encapsulating the pump foam.

Figure 10B:
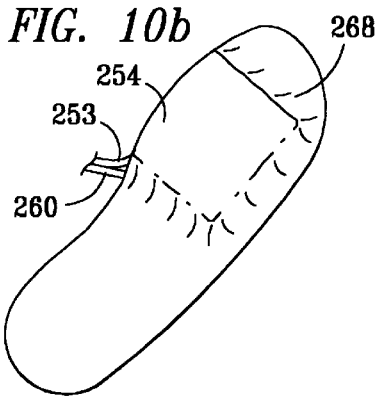
FIG. 10*b* illustrates a finished insole.

Referring now to FIG. 10*b,* there is illustrated the finished insole. The closed cell material 268 forms airtight boundaries around the pump cell 254. This also cushions the area above the outer sole 250, as well as enclosing and forming the airtight pump cell 254, The inner sole material 268 also holds the intake tube 258 and the monotube 260 in place. In this process, the open-cell foam 256 defines the pump perimeter before the closed-cell material 268 is injected into the molding cavity. This process may be performed to provide a removable insole, such as an insert, constructed of the same or similar component as the sole 250.

Figure 10C:
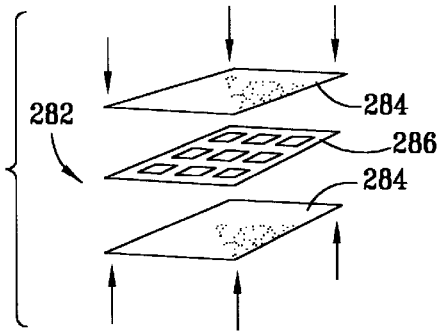
FIG. 10*c* illustrates a composite spring material which may replace the open cell foam.

Referring now to FIG. 10*c,* there is illustrated a composite spring material 282 which may replace the open-cell foam 256. The composite spring consists of multilayers using multiple materials. Two open-cell wafers 284 are placed surrounding a closed-cell foam wafer 286. The two open-cell wafers 284 are attached to the closed-cell wafer 286. The closed-cell wafer 286 may be "waffled" or have other shapes to help absorb shock and to return to its original shape.

Figure 10D:
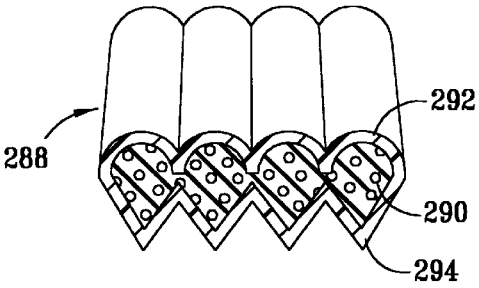
FIG. 10*d* illustrates an alternate composite spring material.

Referring now to FIG. 10*d,* there is illustrated an alternate composite spring material 288. An open-cell foam 290 is deposited between two layers of rubber or vinyl extrusion 292 and 294. The layers 292 and 294 may be formed into various shapes, such as a semicircular shape of the extrusion 292 or in a triangular shape of the extrusion 294. The space in between 292 and 294 is filled with the open-cell foam 290.

Figure 10E:
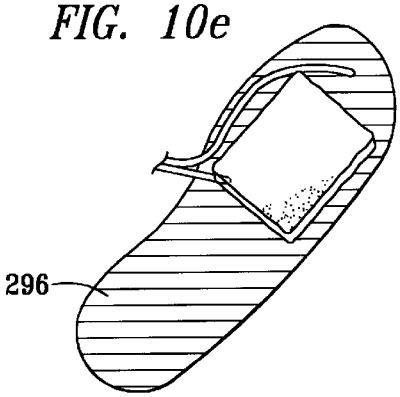
FIG. 10*e* illustrates a top view of a molded insole and the portion thereof which is molded.

Referring now to FIG. 10*e,* the area of the injection mold 296 is depicted by hatching.

Figure 11:
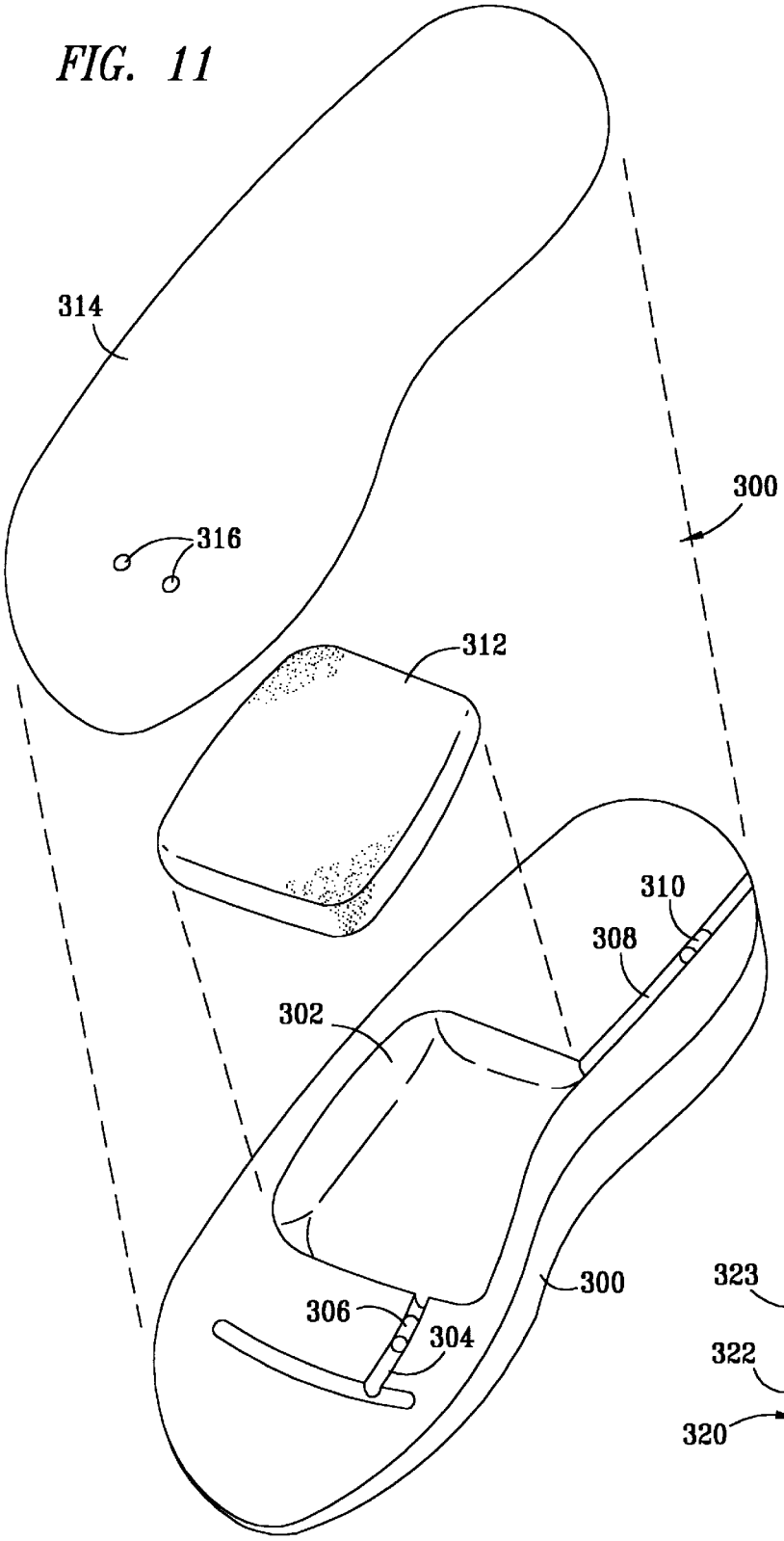
FIG. 11 illustrates a molded pump and hoses.

Referring now to FIG. 11, there is illustrated a molded midsole having an integrally formed pump and intake and exhaust flow channels. The midsole 300 may be provided as a removable insert for a shoe, or may be permanently part of the sole of the shoe. A depression 302 is molded in the midsole 300. The depression 302 is about one-half the depth of the midsole 300 and runs nearly from side-to-side of the midsole 300. An intake channel 304 is also molded into the midsole 300. The intake channel is "T" shaped with the top of the "T" running side-to-side across the toe portion of the midsole 300 and the vertical part of the "T" running into the depression 302. An exhaust channel 308 is also molded into midsole 300. The exhaust channel 308 runs from the rear of the depression 302 to the end of the midsole 300. The depression 302, the intake channel 304 and the exhaust channel 308 are all molded at the time the midsole 300 is molded. An open-cell foam 312 is placed in the molded depression 302 such that half of the open-cell foam 312 rises above the plane of the upper surface of the midsole 300. An airtight flexible membrane 314 is provided having toe channel perforations 316. The toe channel perforations 316 correspond to and are positioned directly over the top of the "T" of the intake channel 304.

An intake valve 306 is pressed into the intake channel 304. The intake valve 306 allows air to pass from the intake channel 304 into the depression 302. An exhaust valve 310 is pressed into the exhaust channel 308. The exhaust valve 310 allows air to pass from the depression 302 through the exhaust channel 308 and out the rear of the midsole 300. The membrane 314 is bonded over the midsole 300, the intake valve 306, the exhaust valve 310, the exhaust channel 308, the intake channel 304 and the molded depression 302. The membrane 314 is sealed in an airtight manner to the flat portions of the top surface of the midsole 300 which were not molded into the channels 308 or 304 or the depression 302.

When pressure is released from the membrane 314, the open-cell foam 312 expands and draws air and moisture through the toe perforations 316 and into the intake channel 304. The air and moisture are then drawn through the intake valve 306 and into the depression 302 and the open-cell foam 312. When pressure is placed on the membrane 314, air and moisture are expelled from the open-cell foam 312 and the depression 302, through the exhaust channel 308, through the exhaust valve 310 and into the outside ambient air exterior of the shoe. The valves 306 and 310 (shown in FIG. 11) could be normal one-way air valves or could be constructed similar to the molded flap valves 320 and 324 (shown in FIG. 12).

Figure 12:
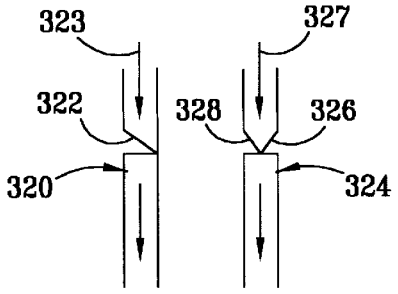
FIG. 12 illustrates two molded flat valves.

Referring now to FIG. 12, there are illustrated two molded flap valves 320 and 324. The single molded flap valve 320 has a single flap 322 when used as a one-way valve, which is pressed open from air passing in the direction of arrow 323. If air and moisture were to try to attempt to pass in an opposite direction to the direction of arrow 323, the flap 322 would be held shut and the air and moisture would not be able to pass through the valve 320. The dual molded flap valve 324 has two molded flaps 326 and 328. When the air and moisture are being passed in the direction of arrow 327, the flaps 326 and 328 are pushed open and air and moisture are allowed to pass. When air and moisture attempt to move in an opposite direction to the direction of arrow 327, the flaps 326 and 328 are pressed closed. The flaps 322, 326 and 328 are molded using the same materials and at the same time that the midsole 300 was molded, which eliminates the need to use separate valve, as shown in FIG. 11.

Figure 13:
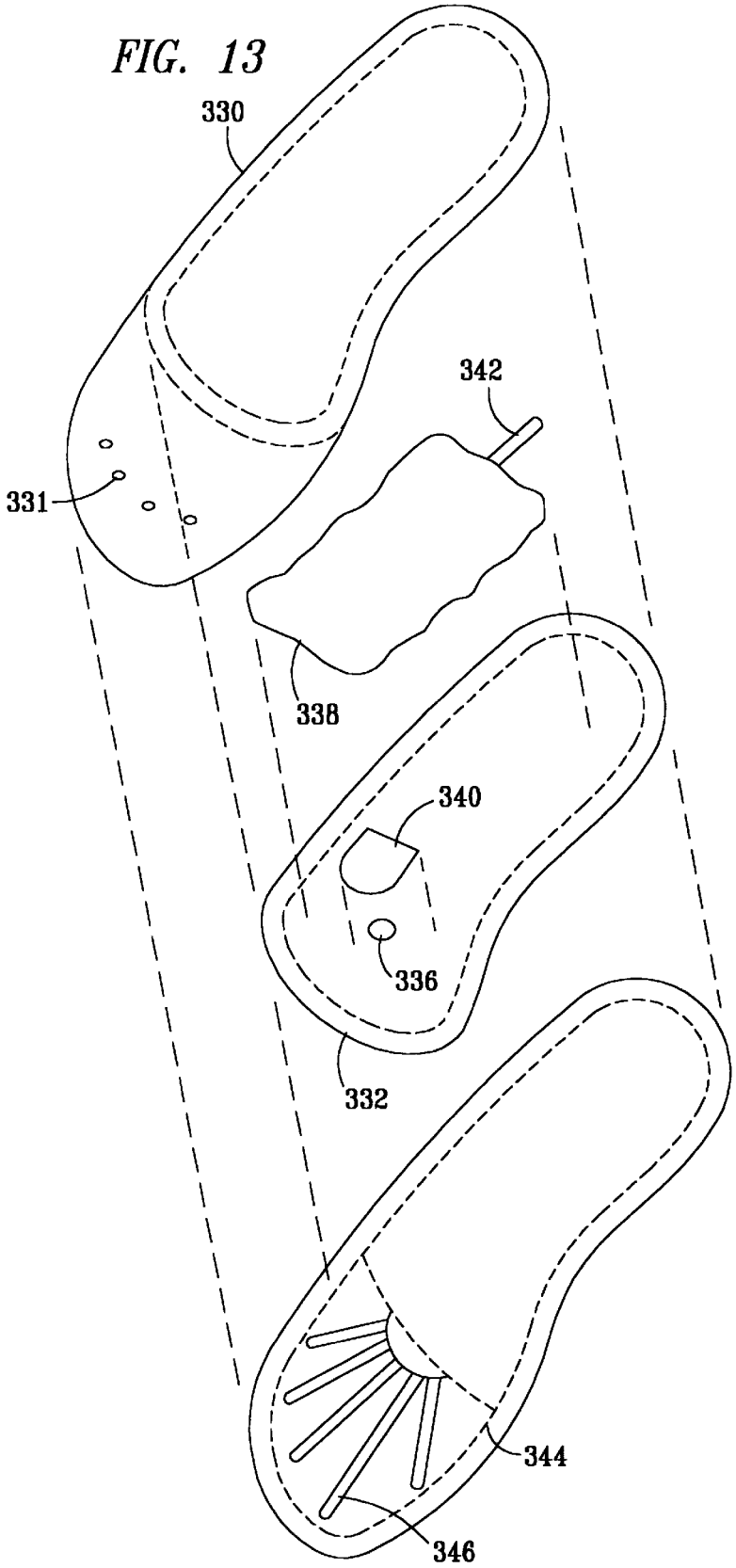
FIG. 13 illustrates a membrane pump with integrated intake.

Referring now to FIG. 13, there is illustrated and expanded view of a membrane pump with integrated intake. A top layer 330 is provided. The top layer 330 is in the shape of the sole of a human foot running the full length from heel to toe. Toe perforations 331 are in the area that would be under the human toes of the top layer 330. A valve layer 332 is provided running from the end of the heel area approximately two-thirds of the distance to the toe area. The valve layer 332 has disposed in it an intake hole 336. Disposed on top of the intake hole 336 is a flap valve 340. The flap valve 340 is attached to the valve layer 342 such that the flap valve 340 lays directly over the intake hole 336. Open-cell foam 330 is disposed between the valve layer 332 and top layer 330. Exit tube 342 is disposed in the rear of the foam 338 extending to the rear. The top layer 330 and the valve layer 332 are welded together along the perimeter of valve layer 332. The foam 338 and the exit tube 342 are captured in between the top layer 330 and the valve layer 332. A bottom layer 344 is provided and is in the shape of a human foot. The bottom layer 344 runs the full distance from the heel to the toe area of the shoe. The bottom layer 344 is then welded to top layer 330, and may have channels or grooves 346 to provide fluid flow paths. This leaves the forward one-third consisting of the bottom layer and the top layer without having the foam 338 between the bottom and top layers. The rear two-thirds is covered by the top layer 330, the valve layer 332, the foam 338 and the bottom layer 344. The weld between the top layer 330 and the valve layer 332 is an airtight weld forming an airtight cell around the foam 338 and the exit tube 342.

In operation, when no pressure is placed on top layer 330, air and moisture are drawn through the toe perforations 331, through the intake hole 336 and then through the flap valve 340 into the open-cell foam 338. When pressure is exerted on top layer 330, air is expelled through the exit tube 342.

Figure 14:
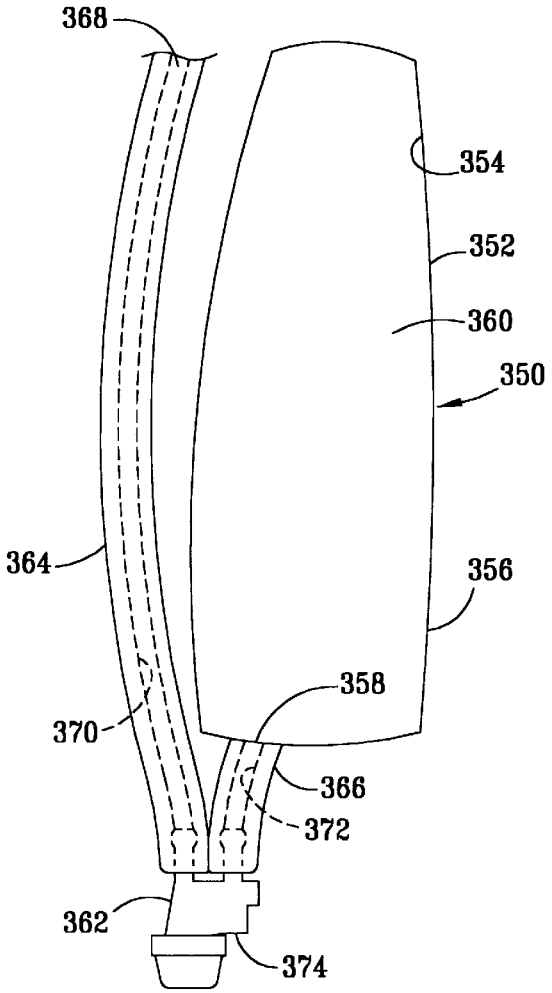
FIG. 14 illustrates top view of a pump assembly having a single, monotube inlet flow port.

Referring now to FIG. 14, there is illustrated a top view of a pump assembly 350 of a shoe ventilation system. The pump assembly 350 includes a pump cell 352, which has a cell wall 354 made of flexible material. The cell wall 354 has a sealed periphery 356 which preferably has a single flow port 358 defining a singular intake/exhaust flowpath extending therethrough. The periphery 356 of the pump cell 352 is sealed over the entire surface of the cell wall 354, except for the single flow port 358, which provides the only fluid flow port for passage of fluids into or out of the pump cell 352. The interior of the pump cell 352 is a foam rubber 360 which has interconnected pore spaces. The pump assembly 350 further includes a valve pod assembly 362. A first tube 364 and a second tube 366 are connected to the valve pod assembly 362. The first tube 364 extends from an intake 368 and defines a single flow passage 372 which connects the intake 368 to the valve pod assembly 362. The second tube 366 defines a single flow passage 372 which extends from the single flow port 358 of the pump cell 352 to the valve pod assembly 362. The valve pod assembly 362 has an exhaust port 374, which provides the exhaust from the pump cell 352 and the pump assembly 350.

Figure 15:
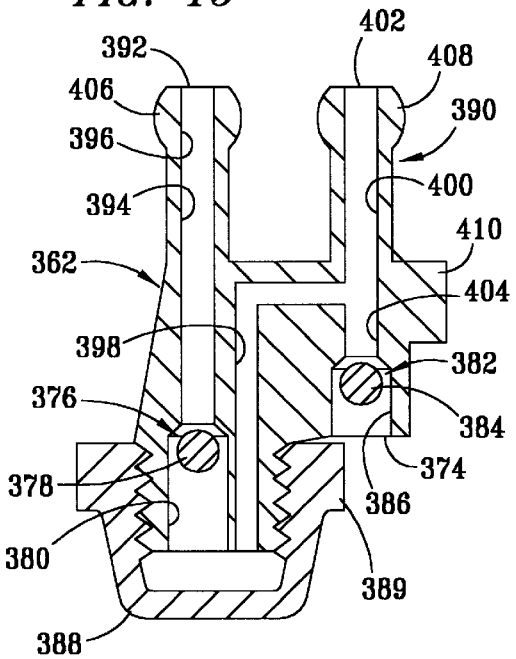
FIG. 15 illustrates a sectional view of a valve pod for use with the pump assembly of FIG. 14.

Referring now to FIG. 15, there is illustrated a sectional view of the valve pod assembly 362. The valve pod assembly 362 has an inlet check valve 376 which provides a one-way flow valve. The inlet check valve 376 has a ball 378 which is disposed within a chamber 380. A valve seat is defined by a wall of one end of the chamber 380 for the ball 378 to sealingly engage against to allow flow in one direction only through the inlet check valve 376. Flow can only pass from the inlet 368 of the pump assembly 350 and through the check valve 376 in a direction of flow extending towards the pump cell 352. The valve pod assembly 362 further includes an exhaust check valve 382. The exhaust check valve 382 includes a ball 384 which is disposed within a chamber 386. Walls defining the chamber 386 have one end which defines a valve seat against which the ball 384 sealingly engages to allow flow through the exhaust valve 382 in one direction only. The fluid air and moisture can only flow through the exhaust check valve 382 in a direction of flow which extends from the pump cell 352, through the exhaust check valve 382 and then through the exhaust port 374 of the pump assembly 350.

An end cap 388 has a circumferentially extending, annular-shaped shoulder 389 which threadingly secures to one end of a main body 390 of the valve pod assembly 362. In other embodiments, the shoulder 389 of the end cap 388 may be sonically welded to the body 390, or a snap connection may be utilized. The shoulder 389 of the end cap 388 is sized such that it will entrap the ball 384 of the exhaust check valve 382 within the exhaust chamber 386 covering a portion of the exhaust port 375. The main body 390 of the valve pod assembly 362 has an inlet 392 and an inlet flow passage 394 which extends to the chamber 380 of the inlet check valve 376. The interior portion of the cap 388 provides a cross-over flow connection from the chamber 380 of the inlet check valve 376 to a flow passage 398, which defines a second portion of the inlet flow passage 394. The first portion 396 of the flow passage 394 extends from the inlet 392 to the chamber 380 of the inlet check valve 376. The inlet flow passage 394 further includes an intake/exhaust flow passage portion 400 which extends from the second passage portion 398 to a pump cell flow port 402. The flow passage portion 400 defines a common flow passage which is shaped by said inlet flow passage 394 and said exhaust flow passage 404.

An exhaust flow passage 404 extends from the pump cell port 402 to chamber 386 of the exhaust check valve 382. The exhaust flow passage 404 includes the intake/exhaust flow passage 400. Two of the ends of the main body 390 of the valve pod assembly 362 have hose fittings 406 and 408 for connecting to the first tube 364 and the second tube 366, respectively. The flow passage 370 is connected in fluid communication to the inlet 392 of the inlet of the flow passage 394. The flow passage 372 of the second tube 366 is connected in fluid communication to the cell port 402 and the intake/exhaust flow passage 400. The main body portion 390 also includes a mounting shoulder 410 which may be entrapped within a portion of an insole material for securing the main body 390 of the valve pod assembly 362 within an insole.

Figure 16:
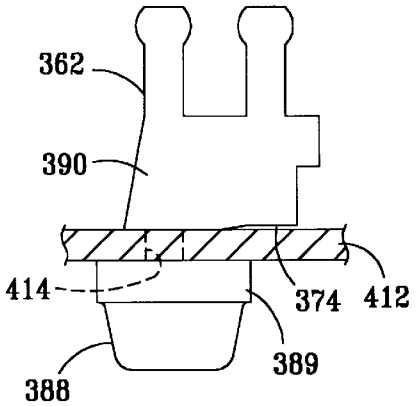
FIG. 16 illustrates a side view of an embodiment of a valve pod for use with the pump assembly of FIG. 14, having a muffler for muffling the flow of exhaust which is discharged from the valve pod.

Referring now to FIG. 16, there is illustrated a top view of the valve pod assembly 362 and an optional muffler 412. The muffler 412 has a hole 414 which extends therethrough. The muffler 412 is disposed between the end cap 388 and the main body 390. The shoulder 389 retains one end of the muffler 412 in a location which is proximate to the exhaust port 374, such that flow from the exhaust port 374 will pass through the muffler 412. Preferably, the muffler 412 is made of a foam rubber, but felt, fabric or other materials may be utilized. The muffler 412 prevents audible noises from occurring due to expulsion of exhaust from within the pump cell 352 and through the exhaust port 374. The hole 414 in the muffler 412 allows passage of exhaust fluids from the interior of a shoe through the inlet flow passage 394 from the intake 368 of the pump assembly 350 and into the pump cell 352. The muffler 412 is disposed adjacent to the exhaust port 374, and in some embodiments fits flush against the exhaust port 374.

Figure 17:
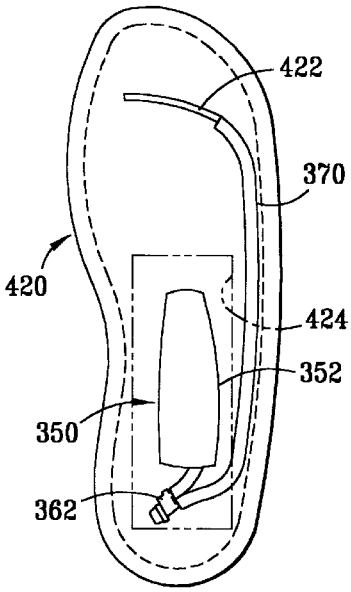
FIG. 17 illustrates a top view of an insole having a pump assembly of a ventilation system.

Referring now to FIG. 17, there is illustrated a top view of an insole 420 having a pump assembly 350 disposed therein. An intake 422 is defined in the forward portion of the insole 420. The intake flow passage 370 extends from the intake 422 to the valve pod assembly 362. The valve pod assembly 362 is connected to the pump cell 352, as discussed above. A cover strip 424 (shown in phantom) extends above the top of the pump assembly 350.

Figure 18:
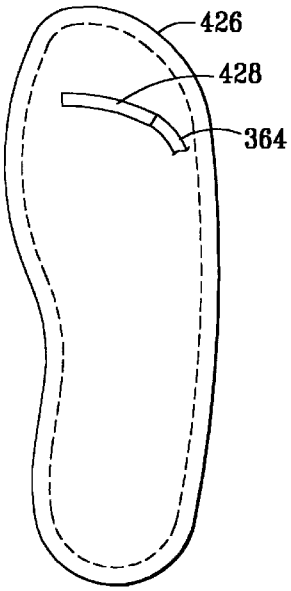
FIG. 18 illustrates a top view of a lower portion of the insole of FIG. 17.

Referring now to FIG. 18, there is illustrated a top view of a lower portion 426 of the insole 420. An arcuately shaped cavity 428 extends in a forward region of the lower portion 426, located in the toe region of the lower portion 426. Preferably, the first tube 364 partly extends into a portion of the arcuately shaped cavity 428.

Figure 19:
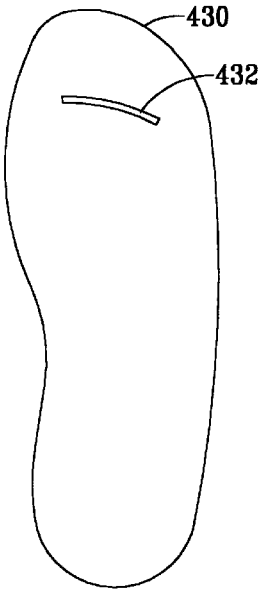
FIG. 19 illustrates a top view of an upper portion of the insole of FIG. 17.

Referring now to FIG. 19, there is illustrated an upper portion 430 of the insole 420. The upper portion 430 has an arcuately shaped intake flow port 432 which has a smaller width than that of the arcuately shaped cavity 428 which is formed into the lower portion 426 of the insole 420. The curvature and the arcuate length of the arcuately shaped cavity 428 are preferably the same as that of the length of the arcuately shaped intake flow port 432 such that the intake flow port 432 overlays the cavity 428 when the peripheral edges of the lower portion 426 and the upper portion 430 are aligned. Preferably, the upper portion 430 is adhesively secured to the lower portion 426 such that exhaust fluids may only enter into the intake 422 by passing through the arcuately shaped intake flow port 432 and then into the arcuately shaped cavity 428. The arcuate shape of the cavity 428 and the intake flow port 432 are provided such that they will align with the curvature of the interface between the toes and the foot. This provides for air flow between the toes and moisture removal therefrom, causing a funnel effect of directing the air flow over a user's foot to dry the user's foot. Thus, fluid flow into the pump assembly 350 will pass over the toe regions of the foot of the user.

Figure 20:
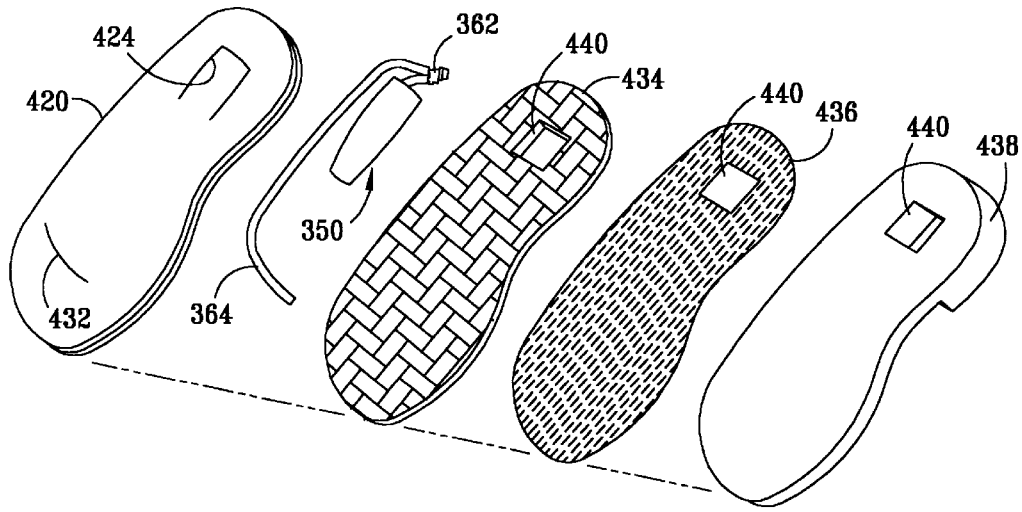
FIG. 20 illustrates an exploded view of a layered embodiment of the insole of FIG. 17.

Referring now to FIG. 20, there is illustrated an exploded view of the insole 420 and outer sole 438 having the pump assembly 350 disposed therebetween. A foam padding layer 434 and a rubber layer 436 are disposed between the outer sole 438 and the insole 420. The foam padding layer 434 fits against the bottom of the insole 420. The rubber layer 436 fits between the foam padding layer 434 and the top of the outer sole 438. A center heel pressure portion 440 is defined in each of the outer sole 438, the rubber layer 436 and the foam padding layer 434. The central portion 440 defines a pressure region, in which a user's heel is centered and the valve pod assembly 362 is disposed. A cover strip 424 is provided for covering the pump cell assembly 350.

Figure 21:
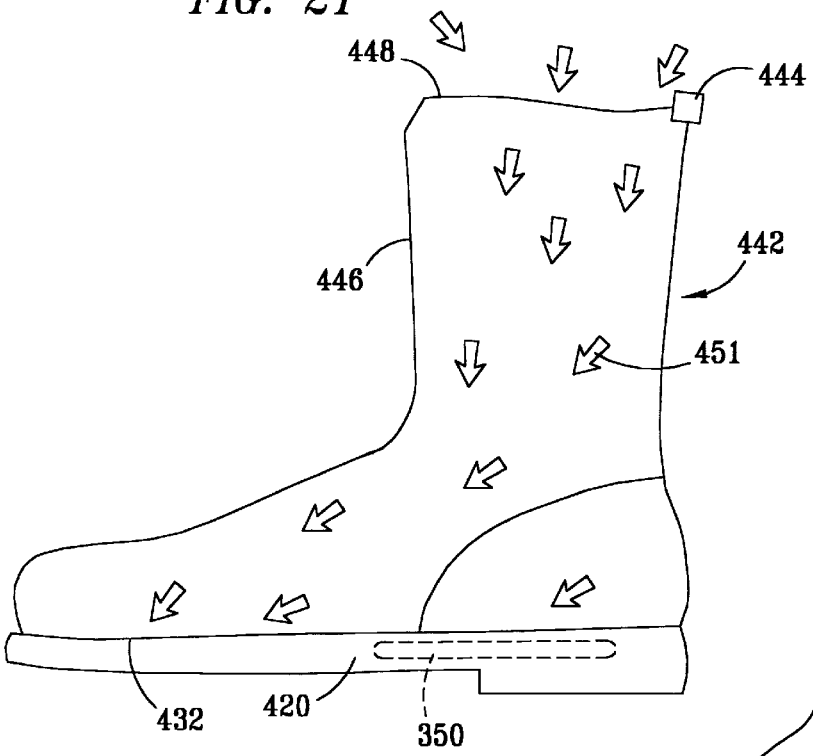
FIG. 21 illustrates a side elevational view of an air cooled shoe of the ventilation system.

Referring now to FIG. 21, there is depicted a side elevational view of an air-cooled shoe 442 which includes the pump cell assembly 350. The air-cooled shoe 442 has an exhaust port 444 which is located at the rearward portion of the top of shoe upper 446 for discharging air. A top opening 448 provides an intake for air flow into the air-cooled shoe 442 in the direction of arrows 450. The intake flow port 432 is located in the forward portion of the sole 420. The pump assembly 350 is disposed within the sole 420. The toe region 452 of a foot 480 is where the air is entrained for passage into the pump assembly 350.

Figure 22:
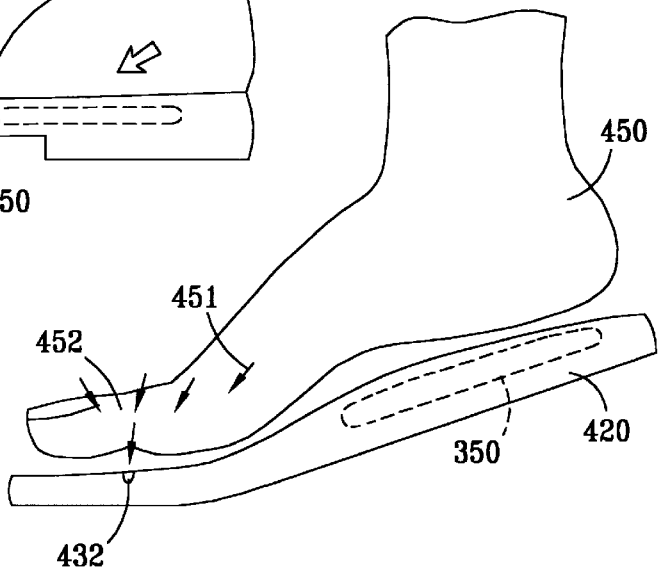
FIG. 22 illustrates a side elevational view of a user's foot and an insole, and depicts air flow around the foot and into the insole of the ventilation system.

Referring now to FIG. 22, there is illustrated a side elevational view of a foot 450 which is disposed on top of the insole 420. The insole 420 has a pump assembly 350 of a shoe ventilation system. Air will pass in the direction of the arrows 451, and flow between a user's toes and then into the arcuately shaped intake flow port 432 in the toe region 452. This provides a funnel effect in which air will be focused to flow between a user's toes, entraining moisture from between the toes. Some of this moisture from the foot 450 wicks across the foot 450 and to the toe region 452.

Figure 23:
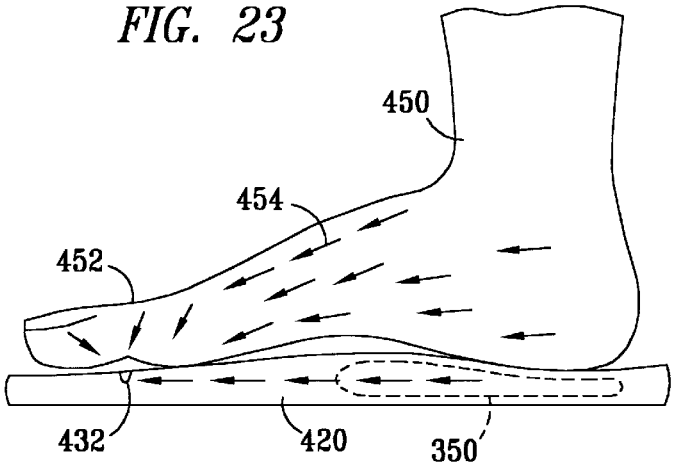
FIG. 23 illustrates a side elevational view of a foot and an insole of an air-cooled shoe, and depicts the path of moisture flow from a foot into the insole.

Referring now to FIG. 23 there illustrated a side elevational view of a foot 450 which is disposed above an insole 420 having a pump assembly 350 of a shoe ventilation system. Moisture will wick from the sock and along the foot 450 in the direction of 454 to the toe region 452. Moisture will then be entrained by air flowing into the arcuately shaped intake flow port 432 and exhausted by the pump assembly 350.

Figure 24:
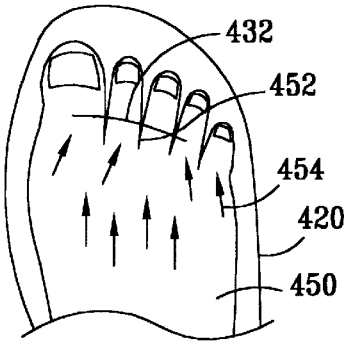
FIG. 24 illustrates a top view of a user's foot and an insole, and depicts moisture movement from various regions of the foot of the user.

Referring now to FIG. 24, there is illustrated a top view of a foot 450 disposed on top of the insole 420. As can be seen, the arcuate shape of the arcuately shaped flow port 432 is such that it is disposed immediately beneath the spaces between the toes of the foot 450, providing a flow path for moisture and air in the direction 454 to pass into the arcuately shaped intake flow port 432 and being exhausted from within the. air-cooled shoe 442.

Figure 25:
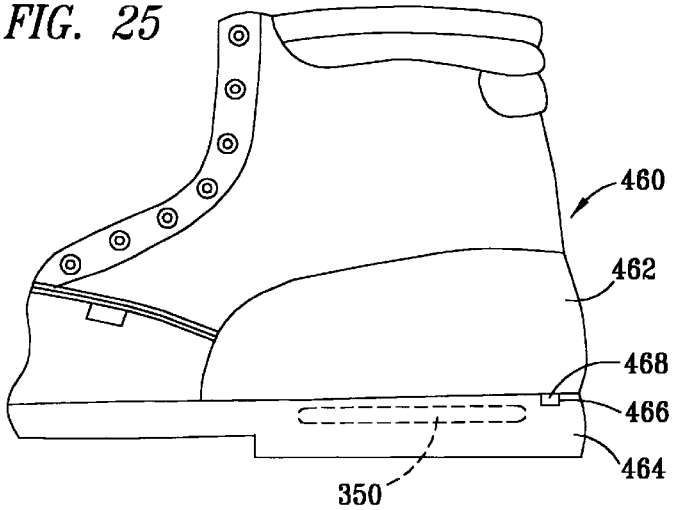
FIG. 25 illustrates a partial, side elevational view of an air-cooled shoe having a ventilation system, depicting an exhaust port which is located in the lower heel portion of an insole of the air-cooled shoe.

Referring now to FIG. 25, there is illustrated a partial, side elevational view of an air-cooled shoe 460 having an upper 462 and a sole 464. The pump assembly 350 is disposed in the sole 464. The exhaust 466 of the pump assembly 350 is disposed in an upper portion of the sole 464, at the rear of the shoe immediately beneath the upper 462. A muffler 468, preferably a foam or fabric layer, covers the exhaust 466.

Figure 26:
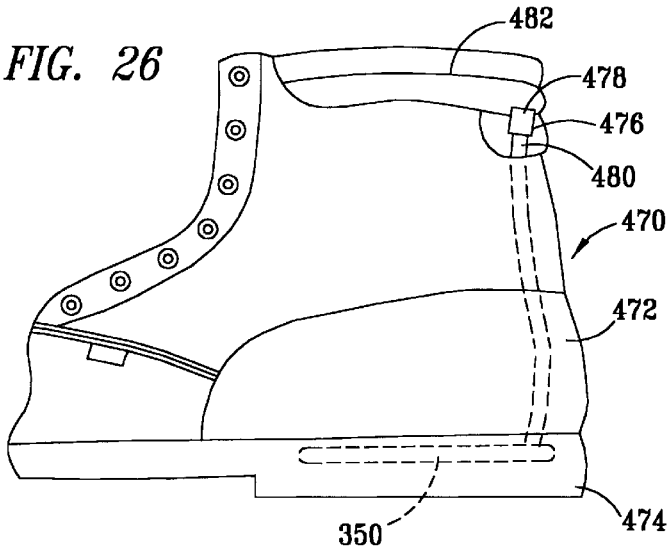
FIG. 26 illustrates an air-cooled shoe having a self-powered ventilation system, with a valve assembly which is disposed at the top rearward regions of the upper of the air-cooled shoe.

Referring now to FIG. 26, there is illustrated a partial, side elevational view of an air-cooled shoe 470 having an upper 472 and a sole 474. Preferably, a pump assembly 350 is included within the air-cooled shoe 470 for exhausting fluids of air and moisture from the interior thereof and passing cooling air across a user's foot. An exhaust 476 of the pump assembly 350 is disposed in an upper portion of the upper 472. A muffler 478 muffles the exhaust 476 to prevent audible noises from being emitted by the air flow from the exhaust 476. A tube 480 extends on the rear portion of the upper 472 downward to the sole 474 and the pump assembly 350. The exhaust 476 is disposed at the top 482 of the upper 472 of the air-cooled shoe 470.

Figure 27:
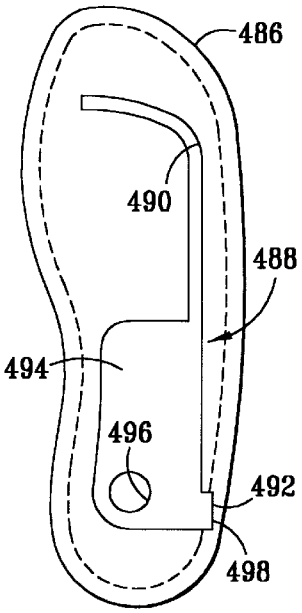
FIG. 27 illustrates a top view of an alternative insole of a shoe ventilation system.

Referring now to FIG. 27, there is illustrated a top view of an insole 486 having a pump 488 of an alternative shoe ventilation system. The pump 488 has an intake passage 490 and exhaust 492. The pump cell 494 has an indentation 496 for centering a user's heel. The cavity 496 is located in the center of a heel portion of the pump cell 494. The exhaust 492 has a cavity 498 within which a valve pod assembly such as the valve 362 is disposed and will be retained.

Figure 28:
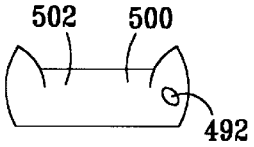
FIG. 28 illustrates a heel portion of an air-cooled shoe of an alternative ventilation system, having an exhaust port which is disposed midway up the heel portion.

Referring now to FIG. 28, there is illustrated a partial rear elevation view of a rear portion 500 of an upper 502 having an exhaust 492 disposed midway up the rear heel portion 500 of the upper 502.

Figure 29:
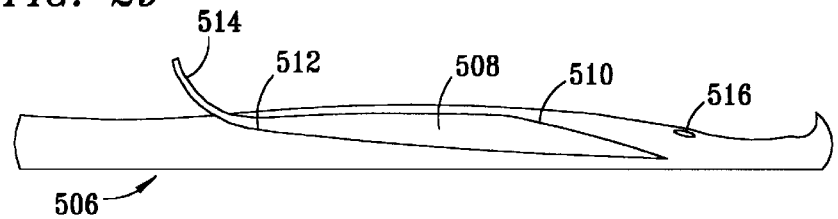
FIG. 29 illustrates a removable insole having a pump cell of a ventilation system integrally formed therein.

Referring now to FIG. 29, there is illustrated a removable insole 506 having a pump cell 508 integrally formed therein. The pump cell 508 has a flexible periphery 510 which is sealed in all portions thereof except for a singular flow port 512, which is the only means for fluid communication from within the interior of the pump cell 508 to the exterior thereof. The flow passage 514 is integrally formed with the pump cell periphery 510 and extends from a portion of the flexible periphery 510 for connecting to a flow passage and a valve pod assembly 362. An intake 516 is provided for connecting to the flow passage 514, with a valve pod assembly 362 connected therebetween. The insole 506 is preferably removably disposed within a shoe to provide ventilation for cooling the shoe. The removable insole 506 may be mounted in various standard sized shoes for retrofitting such shoes for air cooling and mounting a valve pod to the upper portion of uppers of such shoes.

In summary, there has been provided an air-cooled shoe operable to ventilate the interior of the shoe from around the toes of a human foot. The shoe includes an outer sole having a toe portion, a ball portion and a heel portion. A shoe upper is formed above the outer sole and is attached to the outer sole. A pump assembly is disposed in the insole. The pump assembly includes an airtight pump cell defined by a flexible material and filled with an open-cell material which causes the pump cell to expand and fill with air. The pump cell has a single flow port which is connected to both an air intake disposed on the toe portion of the outer sole and an air exhaust connected to the outside ambient air. A valve pod has two check valves which direct flow from the air intake into the pump cell, and then from the pump cell to the air exhaust. The valve pod is preferably comprised of only four parts to provide two valves, wherein the parts are a valve body, which is preferably molded, two moveable valve members and an end cap.

Although the preferred embodiment and several alternative embodiments have been described in detail, it should be understood that various changes, substitutions and alterations can be made therein without departing from the spirit and scope of the invention as defined by the appended claims.

What is claimed is:

1. An air-cooled shoe operable to ventilate an interior of said shoe and the area around a foot disposed within said shoe, comprising:

an outer sole, a shoe upper formed above said outer sole and attached to said outer sole for surrounding the foot;

said shoe having an interior defined to extend between said outer sole and said shoe upper;

a pump mounted to said shoe for disposing beneath the foot, said pump including an air-tight pump cell defined by a flexible material and filled with an expandable material which causes said pump cell to expand and fill with air, said pump cell having a singular flow port which defines a pump intake/exhaust flowpath having first and second ends, with said first end of said intake/exhaust flowpath connected to said pump cell;

an air intake having first and second ends, said air intake being mounted to said shoe such that said first end thereof is in fluid communication with said interior of said shoe;

a first one-way valve having an inlet and an exhaust, said first one-way valve being mounted to said shoe such that said exhaust thereof is in fluid communication with the exterior of said shoe, and said inlet thereof is in fluid communication with said second end of said pump intake/exhaust so that air will only substantially flow through said first one-way check valve in a first direction from said second end of said pump intake/exhaust to the exterior of said shoe; and a second one-way valve having an inlet and an exhaust, said second one-way valve being mounted to said shoe such that said exhaust thereof is in fluid communication with said second end of said pump intake/exhaust and said inlet thereof is in fluid communication with said second end of said air intake so that air will only substantially flow through said second one-way valve in a second direction from said second end of said air intake to said second end of said pump intake/exhaust; and wherein said pump is activated by the pressure of a foot pressing against said pump cell, thereby compressing said pump cell and causing air to be expelled through said pump exhaust and exteriorly of said shoe.

2. The air-cooled shoe of claim 1, wherein said first one-way valve and said second one-way valve are disposed in a valve pod which is detachably mounted to said shoe.

3. The air-cooled shoe of claim 1, further comprising a shut-off valve disposed along said air intake for stopping air and liquid from passing through said air intake.

4. The air-cooled shoe of claim 1, wherein said first end of said air intake is attached to a filtering device for filtering out large particles which are too large to be carried into said pump and exhausted from said shoe.

5. The air-cooled shoe of claim 1, wherein said exhaust of said first one-way valve is restricted, thereby regulating the release of air from said pump, causing said pump cell to collapse slowly.

6. The air-cooled shoe of claim 1, wherein said pump is formed by a depression in said outer sole which is lined with an airtight flexible membrane and then filled with said expandable material; and wherein said air intake and said air exhaust are formed by channels molded in said outer sole and bonded to said airtight flexible membrane with perforations disposed near said first end of said air intake.

7. The air-cooled shoe of claim 1, further comprising a muffler is disposed adjacent used to a final exit exhaust port of said air cooled shoe.

8. The air-cooled shoe of claim 7, where said muffler is formed of foam rubber.

9. The air-cooled shoe of claim 1, wherein said pump cell is mounted to a removable insole which is detachably mounted to said shoe for disposing beneath the human foot, said first one-way valve having one of said inlet and said exhaust thereof connected to an exhaust tube which extends between said pump cell and said shoe upper, and one end of said exhaust tube being attached to one end of said shoe upper for exhausting air to the exterior of said shoe.

10. The air-cooled shoe of claim 1, wherein said air pump, and said first and second one-way valves are operable for passing moisture entrained with said air and liquid from perspiration.

11. An air-cooled shoe operable to ventilate an interior of said shoe and the area around a foot disposed within said shoe, comprising:

an outer sole having a toe portion, a ball portion and a heel portion;

a shoe upper formed above said outer sole and attached to said outer sole for surrounding the foot;

said shoe having an interior defined to extend between said outer sole and said shoe upper;

a pump mounted to said outer sole for disposing beneath the foot, said pump including an air-tight pump cell defined by a flexible material and filled with an expandable material which causes said pump cell to expand and fill with air;

an air intake having first and second air intake ends, said air intake being mounted to said shoe such that said first end of said air intake is disposed proximate to said toe portion of said outer sole and in fluid communication with said interior of said shoe, and said second end of said air intake is connected to said pump cell such that said air intake is in fluid communication with said pump cell;

an air exhaust having first and second air exhaust ends, said first air exhaust end connected to said pump cell such that said first air exhaust is in fluid communication with said pump cell, and said second air exhaust end being connected to the exterior of said shoe such that said second air exhaust is in fluid communication with the exterior of said shoe;

a first one-way valve having a first valve inlet and a first valve exhaust, said first one-way valve being mounted to said shoe and disposed along said air exhaust, said first valve connected to the exterior of said shoe and in fluid communication therewith through said second air exhaust end, and the first valve inlet connected to said pump cell and in fluid communication therewith through said first air exhaust end such that air will only substantially flow through said first one-way valve in a direction from said pump cell to the exterior of said shoe; and a second one-way valve having a first valve inlet and a first valve exhaust, said first valve exhaust connected to said pump cell and in fluid communication therewith through said second air intake end, and said first valve inlet thereof connected to said toe portion of said outer sole and in fluid communication therewith through said first air intake end such that air will substantially only flow through said second one-way valve from said first air intake to said pump cell; and wherein said pump is activated by the pressure of a foot pressing against said pump cell, thereby compressing said pump cell and causing air to be expelled through said pump exhaust and exteriorly of said shoe.

12. The apparatus of claim 1 1, wherein said first one-way valve and said second one-way valve are disposed in a pod which is detachably mounted to said shoe.

13. The apparatus of claim 11, further comprising a shut-off valve disposed along said air intake for stopping air and liquid from passing through said air intake.

14. The apparatus of claim 11, wherein said first end of said air intake is attached to a filtering device for filtering out large particles which are too large to be carried through said pump.

15. The apparatus of claim 11, wherein said exhaust of said first one-way valve is restricted, thereby regulating the release of air from said pump, causing said pump cell to collapse slowly.

16. The apparatus of claim 11, wherein said pump is formed by a depression in said outer sole which is lined with an airtight flexible membrane and then filled with said expandable material; and wherein said air intake and said air exhaust are formed by channels molded in said outer sole and bonded to said airtight flexible membrane with perforations disposed near said first end of said air intake.

17. The apparatus of claim 11, where a muffler is disposed adjacent used to a final exit exhaust port of said air cooled shoe.

18. An air cooled shoe for ventilating air and moisture from around a foot to the exterior of the shoe, comprising:

a sole;

an upper mounted to said sole to define an interior of said shoe, said interior extending between said upper and said sole;

a pump mounted to said sole for moving air and moisture from within said interior to an exterior of said shoe;

a valve pod having a main body which is formed as a singular part, said main body including first and second flow passages and being mounted to said shoe such that said first and second flow passages are connected to said interior of said shoe and an exterior of said shoe, respectively, and said first and second flow passages are connected together to each include a common flow passage which is connected to said pump for passing air and moisture from within said interior of said shoe into said pump and from within said pump to the exterior of said shoe; and said valve pod further having a first and second check valves for controlling flow of air and moisture through respective ones of said first and second flow passages, said first check valve allowing substantial flow of air and moisture only from within said interior of said shoe to said pump and said second check valve allowing substantial flow of air and moisture only from said pump to said exterior of said shoe.

19. The air cooled shoe of claim 18, further comprising a muffler member mounted to an exhaust of said second flow passage from within said valve pod to prevent flow from within said second flow passage from exceeding a maximum value.

20. The air cooled shoe of claim 18, wherein said valve pod is mounted to a portion of said shoe which is distally disposed from said pump.

21. The air cooled shoe of claim 18, wherein said first and second check valves are ball check valves and sealing seats which respective ones of balls of said first and second check valves seal against are molded into said main body of said valve pod.

22. The air cooled shoe of claim 21, wherein said check valves are in part defined by ball chambers which are molded into said main body of said valve pod, and an end cap seals a first of said chambers and has a shoulder which retains one of said balls within a second of said chambers, without said end cap sealing air and moisture within said second of said chambers.

23. A method of ventilating an interior of a shoe from an area disposed around a foot, comprising:

drawing air from the interior of the shoe into an air intake having first and second air intake ends, the first air intake end being disposed proximate to the toe portion of the outer sole, and in fluid communication with the interior of the shoe;

pumping air from the air intake to the outside ambient air using a pump disposed under the foot and mounted to the shoe, the pump including an air-tight pump cell defined by a flexible material and filled with an expandable material which causes the pump cell to expand and fill with air, the pump cell having a single pump intake/exhaust flow port in fluid communication with the pump cell;

allowing air to flow only from the single pump intake/exhaust flow port to the outside ambient air using a first one-way valve having a first valve inlet and a first valve exhaust, the first one-way valve being mounted to the shoe such that the first valve exhaust is in fluid communication with the exterior of the shoe and the first valve inlet is in fluid communication with the single pump intake/exhaust flow port; and allowing air and liquid to only substantially flow only from the second air intake end to the pump intake/exhaust flow port using a second one-way valve having a second valve inlet and a second valve exhaust, the second one-way valve being mounted to the shoe such that the second valve exhaust is in fluid communication with the single pump intake/exhaust flow port and the second valve inlet is in fluid communication with the second air intake end.

24. The method of claim 23, further comprising the step of disposing the first one-way valve and the second one-way valve in a pod which is detachably mounted to the outer shoe.

25. The method of claim 24, wherein said valve pod is detachably mounted to the outer shoe at a location which is distally disposed from said pump cell.

26. The method of claim 23, further comprising the step of disposing a shutoff valve along the air intake for stopping air from passing through the air intake.

27. The method of claim 23, further comprising the step of attaching a filtering device to the first end of the air intake for filtering out large particles which are too large to be carried through the pump.

28. The method of claim 23, further comprising the step of restricting the first valve exhaust, thereby regulating the release of air from the pump and providing a collapsing cushion.

29. The method of claim 23, further comprising a step of muffling air flow from the shoe such that audible noises are prevented.

* * * * *